US007055697B2

(12) United States Patent
McDonald

(10) Patent No.: US 7,055,697 B2
(45) **Date of Patent: *Jun. 6, 2006**

(54) SYSTEM FOR SEPARATING FLUID-BORNE MATERIAL FROM A FLUID THAT CARRIES PARTICULATE MATTER ALONG WITH THE MATERIAL

(75) Inventor: Joseph P. McDonald, Appleton, WI (US)

(73) Assignee: Whitewater Solutions Corp., Appleton, WI (US)

( * ) Notice: Subject to any disclaimer, the term of this patent is extended or adjusted under 35 U.S.C. 154(b) by 73 days.

This patent is subject to a terminal disclaimer.

(21) Appl. No.: 10/617,286

(22) Filed: Jul. 10, 2003

(65) Prior Publication Data

US 2004/0016685 A1 Jan. 29, 2004

Related U.S. Application Data

(63) Continuation-in-part of application No. 10/194,785, filed on Jul. 12, 2002, now Pat. No. 6,622,868.

(51) Int. Cl.
*B07B 1/24* (2006.01)

(52) U.S. Cl. ..... 209/254; 209/252; 209/268; 209/270

(58) Field of Classification Search ..... 209/274, 209/275, 276, 277, 278, 279
See application file for complete search history.

(56) References Cited

U.S. PATENT DOCUMENTS 973,149 A * 10/1910 Warner ..... 209/270
1,138,741 A * 5/1915 Fowler ..... 209/301

(Continued)

FOREIGN PATENT DOCUMENTS

EP 000567208 A2 * 10/1993

OTHER PUBLICATIONS

"Screen Reinvented", Kroosh Technologies, www.kroosh.com, Mar. 20, 2002.

(Continued)

*Primary Examiner*—Donald P. Walsh
*Assistant Examiner*—Jonathan R. Miller
(74) *Attorney, Agent, or Firm*—Boyle, Fredrickson, Newholm, Stein & Gratz, S.C.

(57) ABSTRACT

A system for screening fluid-borne material from a fluid that carries particulate matter along with the material, e.g. for screening usable fibers in papermaking or tissue making white water that also contains waste material such as fines and ash. The system employs a flexible and pliable screen to which the fluid is applied. The screen is supported in a suspended manner from a frame. The fluid is directed onto an inside surface defined by the screen, and the location at which the fluid strikes the screen is varied so as to result in bending and flexing of the screen due to the flexibility and pliability of the screen material. In this manner, the configuration of the screen drainage passages is continuously altered, to provide a self-cleaning action that prevents the screen passages from plugging or blinding over. In one form, the screen is generally frustoconical, and the fluid is applied to the inside surface of the screen in a manner which results in rotation of the screen. The material retained on the screen is directed toward a discharge opening defined by the lower end of the frustoconical screen, and the waste water including the particulate matter passes through the screen and is collected in a waste water collection tank. In another form, the screen is suspended from a frame to form a trough configuration having an open discharge end. The frame is movable in either an axial direction or a transverse direction, to cause movement of the screen and to obtain the desired flexing and bending of the screen to self-clean the screen drainage passages.

56 Claims, 16 Drawing Sheets

U.S. PATENT DOCUMENTS

| | | | | | |
|---|---|---|---|---|---|
| 1,897,156 | A | | 2/1933 | Wells | |
| 2,563,249 | A | * | 8/1951 | Koziol | 209/270 |
| 2,983,378 | A | | 5/1961 | Hilkemeier | |
| 2,984,622 | A | * | 5/1961 | Bruninghaus | 210/785 |
| 3,081,873 | A | | 3/1963 | Cowan et al. | |
| 3,220,546 | A | | 11/1965 | Gardner | |
| 3,394,809 | A | * | 7/1968 | Hunter | 209/273 |
| 3,501,002 | A | | 3/1970 | Talley, Jr. | |
| 3,637,077 | A | | 1/1972 | Cowan | |
| 3,692,183 | A | | 9/1972 | Tra | |
| 3,720,316 | A | | 3/1973 | Riesbeck et al. | |
| 4,374,728 | A | | 2/1983 | Gauld | |
| 4,613,432 | A | | 9/1986 | Racine et al. | |
| 4,697,982 | A | | 10/1987 | Hooper | |
| 5,051,171 | A | | 9/1991 | Hukki | |
| 5,152,891 | A | * | 10/1992 | Netkowicz et al. | 210/408 |
| 5,182,008 | A | * | 1/1993 | Shelstad | 210/139 |
| 5,224,603 | A | | 7/1993 | Hanana et al. | |
| 5,259,955 | A | * | 11/1993 | Bolton | 210/406 |
| 5,431,287 | A | | 7/1995 | Knox | |
| 5,653,346 | A | * | 8/1997 | Frei et al. | 209/254 |
| 5,771,718 | A | | 6/1998 | Ide et al. | |
| 5,839,142 | A | * | 11/1998 | Bolton | 8/156 |
| 5,992,641 | A | * | 11/1999 | Caldwell, Jr. | 209/273 |
| 6,010,012 | A | | 1/2000 | Gero | |

OTHER PUBLICATIONS

"The Original Gravity Strainer", Strain-EL HyXoOy, Pulp & Paper Technology, Inc., 3250 Peachtree Industrial Blvd., Suite 110, Duluth, GA 30096-8310, undated.

"AES Fiber Retriever", Bulletin STR-1000, Feb. 96, AES Engineered Systems, Queensbury, NY 12804.

"Para-Flow Inclined Screen", PF300R2M, 2000, AES Engineered Systems, Queensbury, NY 12804.

Recycle/Reuse Water With The PETAX Fine Filtration System, 2001, AES Engineered Systems, Queensbury, NY 12804.

* cited by examiner

SYSTEM FOR SEPARATING FLUID-BORNE MATERIAL FROM A FLUID THAT CARRIES PARTICULATE MATTER ALONG WITH THE MATERIAL

CROSS-REFERENCE TO RELATED APPLICATION

This application is a continuation-in-part of application Ser. No. 10/194,785 filed Jul. 12, 2002, now U.S. Pat. No. 6,622,868.

BACKGROUND AND SUMMARY OF THE INVENTION

This invention relates to a process for making products such as paper or tissue from pulp or other fiber-containing material, and more particularly to a process for recovering and recirculating usable fibers contained in water produced in such a process.

The manufacture of products such as paper and tissue uses fibrous material such as wood pulp, which is processed in a known manner to produce the desired end product. In a paper or tissue making process, the pulp is applied to a screen or papermaking fabric from a headbox, and water is pressed out of the pulp in a known manner to form the paper or tissue, which is dried and formed into a roll. The water that is pressed out of the pulp is commonly known as white water, and typically includes small particles of fines and ash material which pass through the fabric along with the water. In addition, the white water inevitably includes a quantity of usable fibers that pass through or around the papermaking fabric, which are wasted if the white water is discarded. This is a recognized problem in the tissue industry, and has resulted in the development of systems that recirculate the white water back into the pulp supply system, to recirculate the usable fibers. However, such systems also recirculate the fines and ash material. This is acceptable in a papermaking process, in which the fines and ash material can be incorporated into the paper. However, the presence of such material is very detrimental in a tissue making process, in that the small particles of material inhibit drainage. Accordingly, simple recirculation systems are undesirable in a tissue making process, since the undesirable fines and ash are simply continuously recirculated in the process. Certain screen systems, which employ a stationary screen, have been developed in an effort to separate the usable fibers from the fines and ash. Typically, fibers retained on the screen are intermittently doctored off the screen and recirculated in the pulp supply system. Because such systems necessarily use screens with small openings, there is a significant tendency for the screen openings to plug or "blind over" due to the buildup of material in the openings. Accordingly, many known systems either do not function properly for this reason, or require a great deal of maintenance to keep the screen openings from plugging.

It is an object of the present invention to provide an effective system for recovering usable fibers from white water in a papermaking system, in order to enable usable fibers to be recirculated into the system without recirculating the undesirable unusable material such as fines and ash commonly found in papermaking white water. It is another object of the invention to provide such as a system which involves little modification to an existing papermaking circulation system, while enabling recovery of usable fibers from white water and recirculating the usable fibers for use. It is a further object of the invention to provide such a system which requires little maintenance and which is relatively simple in its components, construction and operation, to enable the system to be installed and operated at a relatively low cost so as to justify recovery and recirculation of usable fibers from the white water. It is a further object of the invention to replace ineffective existing recovery systems with a recovery system that provides a clean supply of material to the forming fabric to enable more efficient operation of the system.

In accordance with the present invention, a fiber recovery system for a tissue or papermaking process utilizes a filter or screen, onto which white water from the process is directed at a location downstream of a white water collection vessel forming a part of the papermaking system. The screen is sized so as to allow water containing the undesirable or unusable components of the white water, such as fines and ash, to pass through the screen while retaining usable fibers on the screen. The water containing the undesirable or unusable material is routed to a wastewater treatment facility, in a conventional manner, and the cleaned water can then be resupplied to the system. The screen, onto which the white water is directed, is formed of a flexible and pliable screening material, which may be the same type of material as is commonly employed as the fabric in a tissue or papermaking system. The screen is supported in a manner such that the screen is maintained relatively loose and flexible, e.g. by suspending the screen from a frame. The screen is subjected to motion as the white water is directed onto the screen, which results in flexing of the material of the screen, to provide a self-cleaning action of the screen that prevents plugging and blinding of the screen openings. The invention contemplates several different arrangements for supporting and imparting motion to the screen, and for directing the white water onto the screen. In all versions, the white water is applied to an interior area defined by the screen, and the usable fibers are collected on the inner surface of the screen. The screen is configured to direct the usable fibers to an open discharge area, where the usable fibers are discharged from the screen. The usable fibers are then returned to the system and incorporated into the fibrous material supplied to the headbox, for subsequent application to the tissue or papermaking fabric.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
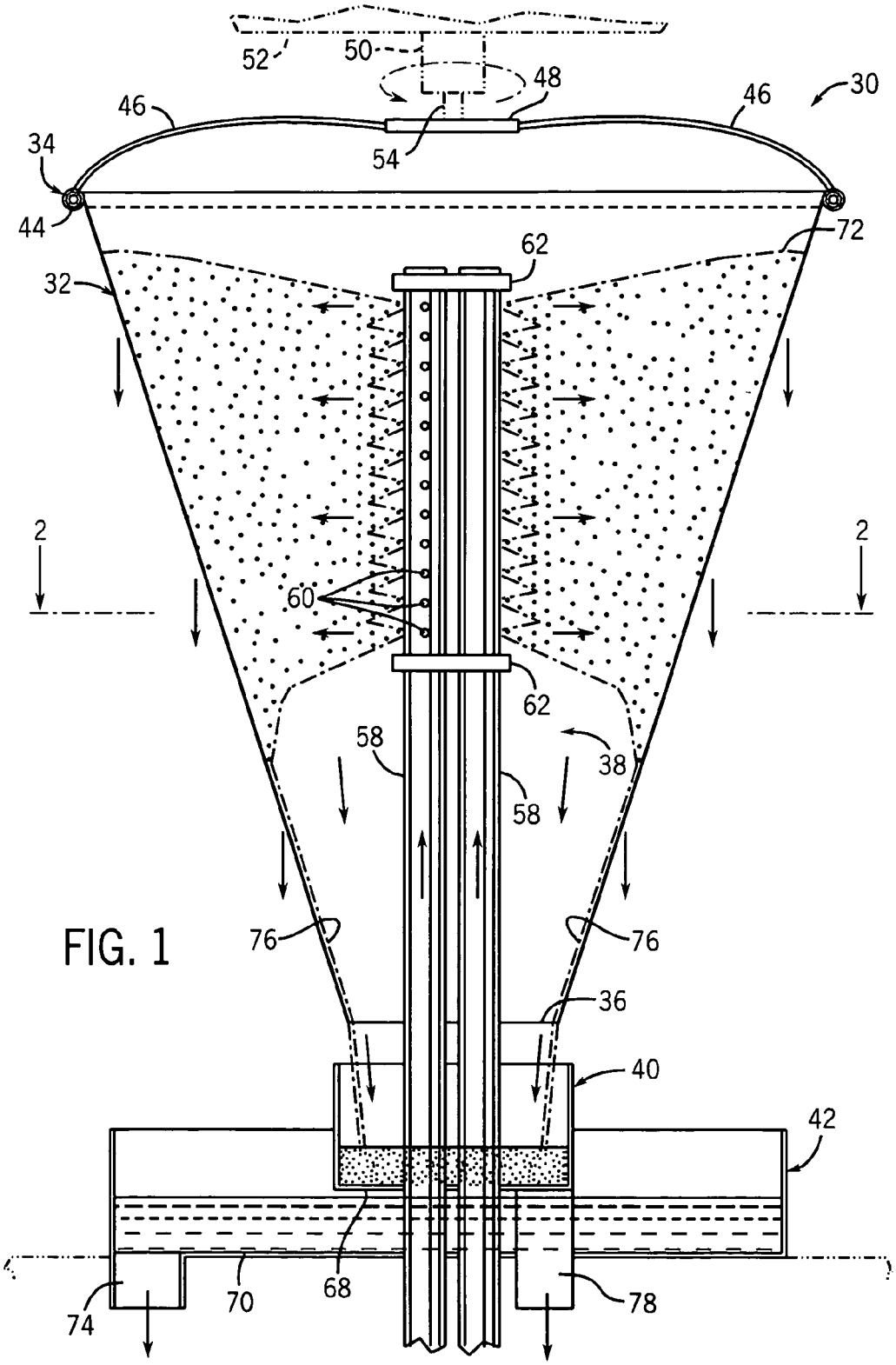
FIG. 1 is a side elevation view, partially in section, showing one embodiment of a fiber recovery system in accordance with the present invention.
Figure 2:
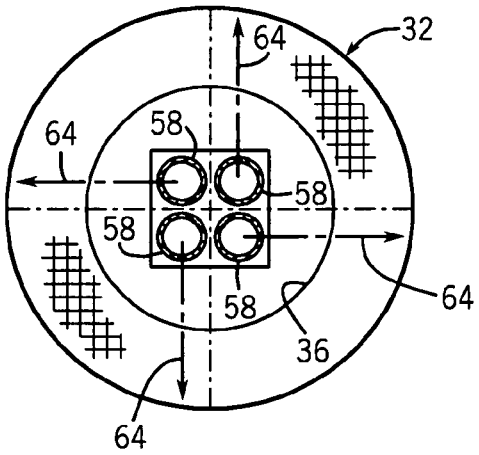
FIG. 2 is a partial section view taken along line 2—2 of FIG. 1, showing the screen at rest.
Figure 3:
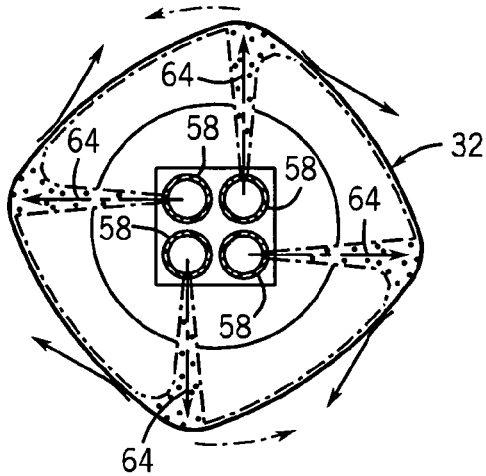
FIG. 3 is a view similar to FIG. 2, showing operation of the system and rotational movement of the screen.

FIGS. 1–3 illustrate a first embodiment of a fiber recovery system, shown generally at 30, in accordance with the present invention, which is particularly well suited for use in a tissue making process. Generally, fiber recovery system 30 includes a screen 32 suspended from a frame 34 and configured to define a discharge opening 36, in combination with a white water supply system 38 which is operable to direct white water from a papermaking system onto a surface of screen 32. Fiber recovery system 30 also includes an upwardly open fiber collection vessel or tank 40 located below discharge opening 36 of screen 32, and an upwardly open waste water collection vessel or tank 42.

Screen 32 is formed of a flexible and pliable screening material, and is frustoconical in shape. The material of screen 32 may be of the same type that is used as the fabric in a tissue making process. Representatively, the material of screen 32 is a screen material such as is available from Albany International, Appleton, Wire Division, Appleton, Wis. under Model No. M-Weave, Duraform, Z-76, which is a five shed tissue making screen material having a strand count of 84/in. (M.D.), 78/in. (C.D.), a permeability of 730 CFM and a caliper of 0.016 inches. It is understood that this type of screen material is representative of various types of screen material that may be employed, depending upon the size of fibers to be collected as well as various other operating parameters. For example, the strand size, count and weave pattern of the screen material may vary from the illustrated embodiment. The function of the flexibility and pliability of screen 32 will later be explained.

The upper end of screen 32 is secured to frame 34, so that screen 32 is suspended from frame 34. Frame 34 includes an outer peripheral frame member 44, which is generally circular, and to which the upper end of screen 32 is connected. Frame 34 further includes a series of radial spokes 46 that extend between outer frame member 44 and a hub 48. A mounting member 50 is secured to any satisfactory upper support member 52, and includes a rotatable shaft 54 to which hub 48 is connected. In this manner, frame 34 and screen 32 are rotatable about a longitudinal axis of rotation defined by the longitudinal axis of screen 32, which is coincident with the longitudinal axis of shaft 54.

Screen 32 is configured such that its sides are oriented at an angle of approximately 30° from vertical, so as to define an included angle of approximately 60°. Representatively, screen 32 defines an upper diameter of approximately 48 inches, where screen 32 is connected to outer frame member 44, and discharge opening 36 has a diameter of approximately 7 inches. The height of screen 32 is approximately 41 inches. These dimensions are believed to provide sufficient throughput to accommodate the amount of white water generated in most tissue making operations. It is understood that these dimensions and angles are provided to illustrate one embodiment of screen 32 and frame 34 which have been found to provide satisfactory results, and that other dimensions and angles may also be found to function satisfactorily. For example, the size of screen 32 may be increased to accommodate a larger volume of white water that may be generated in higher volume tissue making operations.

White water supply system 38 is operable to direct white water from a papermaking process onto the inside surface of screen 32. As shown in FIGS. 1–3, white water supply system 38 is in the form of a series of upwardly extending conduits 58, which are centered on a longitudinal axis coincident with the longitudinal axis of screen 32. Each conduit 58 is provided with a series of spaced openings 60 along its length, and is closed at its upper end. Representatively, each conduit 58 has an inside diameter of 3.0 inches, although it is understood that any other satisfactory conduit size may be employed. Conduits 58 extend through brackets 62, which function to maintain the position of conduits 58 relative to each other. Openings 60 in each conduit 58 are arranged in a linear fashion. The line of openings 60 in each conduit 58 is radially oriented so as to face in a direction perpendicular to the facing direction of the line of openings 60 in the adjacent conduit 58. As shown in FIG. 2, each line of openings 60 is oriented so as to face in a direction parallel to and laterally offset from a radius of screen 32. In this manner, each line of openings 60 functions to direct white water onto the inner surface of screen 32 in a direction generally indicated by an arrow 64 (FIG. 2), so that white water impinging on the inner surface of screen 32 applies both a radial force and a tangential force to the inside surface of screen 32. Representatively, each opening 60 is circular in shape, and has a diameter of approximately 0.375 inches, although it is understood that any other shape and transverse dimension may be employed.

Conduits 58 extend through a bottom wall 68 defined by fiber collection tank 40, and through a bottom wall 70 defined by waste water collection tank 42. Openings are formed in tank bottom walls 68 and 70 to accommodate passage of conduits 58 therethrough, and appropriate fluid-tight seals are provided between conduits 58 and tank bottom walls 68, 70. Alternatively, conduits 58 may be routed laterally outwardly between discharge opening 36 and fiber collection tank 40, to avoid the difficulties and maintenance associated with sealing between conduits 58 and walls 68, 70.

In operation, fiber recovery system 30 functions as follows to recover usable fibers from papermaking white water, which is supplied through conduits 58. The white water is directed toward the inside surfaces of screen 32 by emission through openings 60 of conduits 58. Each line of openings 60 forms a series of linear white water shower streams, so that white water is applied to the inside surfaces of screen 32 generally in a pattern shown at 72. The tangential component of the force with which each shower of white water strikes the inside surface of screen 32 functions to impart rotation to screen 32 about its longitudinal axis, by rotation of shaft 54 relative to mounting member 50. The speed of rotation of screen 32 is dependent upon the amount of force applied by each shower of white water, which is proportional to the pressure of the white water in conduits 58, as well as the angle of the white water shower streams. Representatively, it has been found that satisfactory operation is obtained by maintaining a low pressure of (e.g. 5 psi) in conduits 58 functions to apply a force to screen 32 which causes screen 32 to rotate at a speed of approximately 40 rpm.

The openings of screen 32 are sized to retain usable fibers on the inside surface of screen 32, and to allow water and waste material contained within the white water, such as fines and ash, to pass through the openings of screen 32. The waste water passes through screen 32 to the exterior of screen 32, and falls by gravity into waste water collection tank 42. The waste water may also travel down the outside surfaces of screen 32. If desired, a shirt is provided at the lower end of screen 32 so as to direct the waste water outwardly into waste water collection tank 42. The waste water is then routed through a waste water outlet 74 of waste water collection tank 42 to a waste water treatment system, where the solids are removed and the cleaned water can be recirculated into the papermaking process.

The usable fibers contained within the white water, which are retained on the inside surface of screen 32, travel downwardly on the inside surface of screen 32 toward discharge opening 36, by gravity. The layer of usable fibers collected on the inside surface of screen 32 is representatively illustrated at 76. As the usable fiber layer 76 travels downwardly on the inside surface of screen 32, the centrifugal forces due to rotation of screen 32 function to expel additional water and waste material through the openings of screen 32 as the usable fibers advance toward discharge opening 36. In this manner, the usable fibers that are discharged through discharge opening 36 are of a relatively thick consistency, having most of the waste water expelled therefrom. The usable fibers are collected in fiber collection tank 40, and are routed through a fiber discharge outlet 78 of collection tank 40 to a pump, which recirculates the usable fibers into the papermaking process. Alternatively, fiber recovery system 30 may be installed above chest level, such that gravity flow is employed in place of a pumping operation to recirculate the usable fibers.

Figure 4:
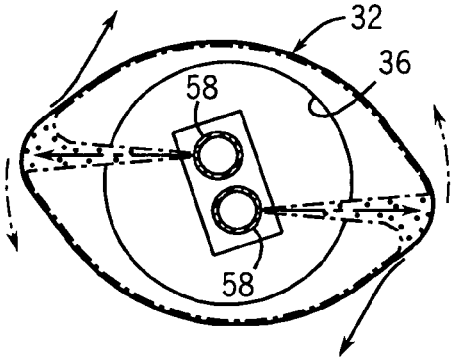
FIGS. 4 and 5 are views similar to FIG. 3, showing alternative arrangements for directing the white water onto the screen.
Figure 5:
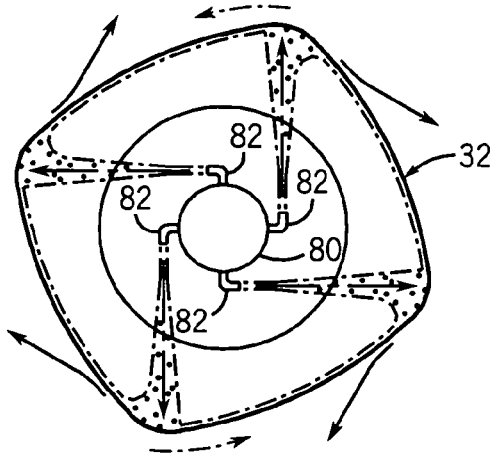

The white water may be applied to screen 32 in various other ways, and examples are illustrated in FIGS. 4 and 5. As shown in FIG. 4, two supply conduits 58 may be employed to apply the white water to screen 32 in place of the four conduits 58 as illustrated in FIGS. 2 and 3. Again, the openings 60 in conduits 58 are arranged so as to be offset relative to the center of screen 32 and relative to radii of screen 32, to apply the showers to screen 32 with a tangential force to impart rotation to screen 32. FIG. 5 illustrates another embodiment, in which white water is supplied through a single conduit 80, with a series of elbows 82 that provide the radial offset of the shower to apply a tangential force to screen 32 so as to impart rotation to screen 32.

While FIGS. 1–5 illustrate a certain embodiment of the invention, it is understood that variations to this version are possible and contemplated as being within the scope of the present invention. For example, and without limitation, it is contemplated that rotation to screen 32 may be accomplished by use of a motor, to ensure that screen 32 rotates at a desired speed. In a version such as this, the white water showers are preferably applied to the screen in a radial manner, to thereby eliminate the tangential component of the force applied by the shower. Further, while screen 32 has been illustrated as having a straightsided frustoconical configuration, it is also considered that the sides of screen 32 may have a convex or concave configuration if desired. The white water may also be applied to the inside surface of the screen in any location and in any manner, and the illustrated embodiments are understood to simply be representative of a variety of ways by which the white water may be applied. While the drawings illustrate the use of four showers to apply white water to the screen, it is understood that any desired number and size of showers may be employed.

The flexibility of screen 32 enables screen 32 to deform from its normal shape during operation as white water is directed onto and strikes screen 32. As shown in FIG. 3, the four showers applied to screen 32 function to deflect the portions of the screen outwardly where the white water showers are applied, to provide generally convex arcuate side areas between the outwardly deformed areas. This flexibility and pliability of the screen material provides a "self-cleaning" action of the screen, in that the individual strands of screen material flex and bend to prevent the build-up of material in the corners of the screen openings, which can result in plugging of the screen openings and "blinding" of the screen. Fiber recovery system 30 thus requires very little maintenance, while providing an extremely effective and efficient system for collecting usable fibers and separating out unusable material.

Figure 6:
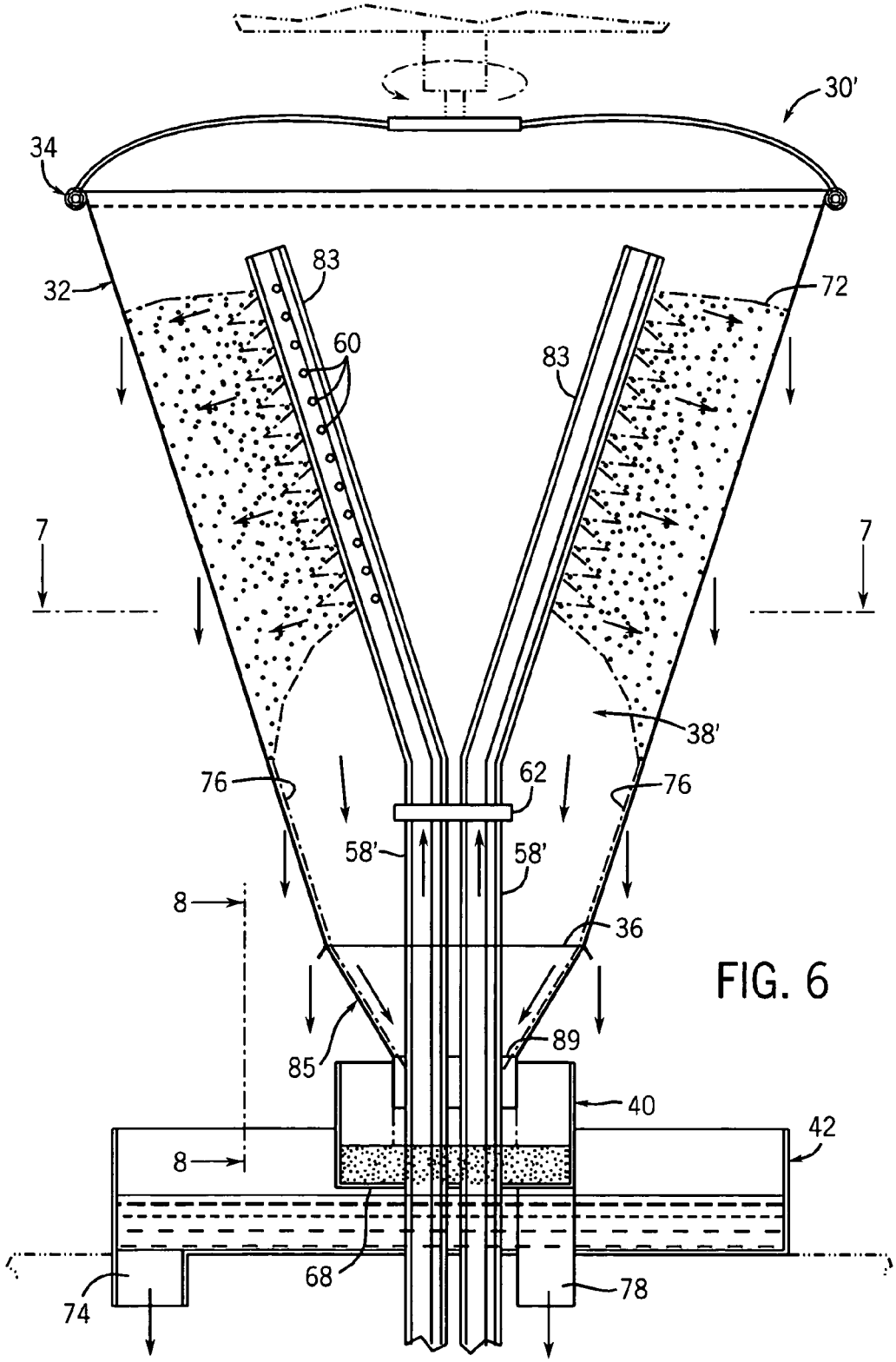
FIG. 6 is a view similar to FIG. 1, showing an alternative embodiment of the fiber recovery system of the present invention.
Figure 7:
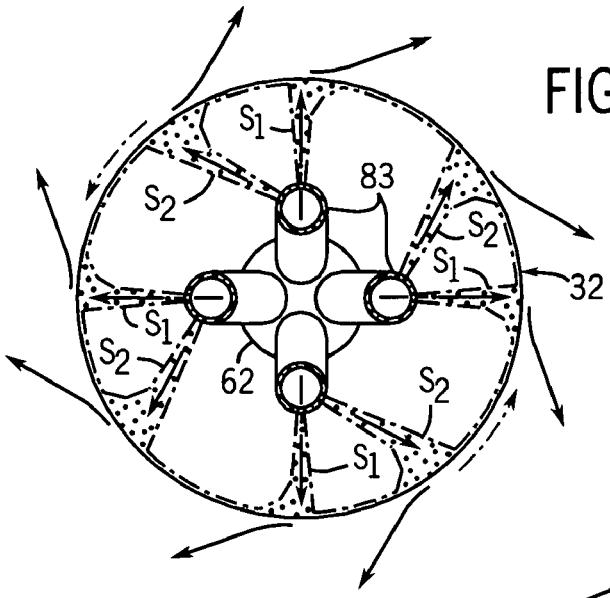
FIG. 7 is a section view taken along line 7—7 of FIG. 6.
Figure 8:
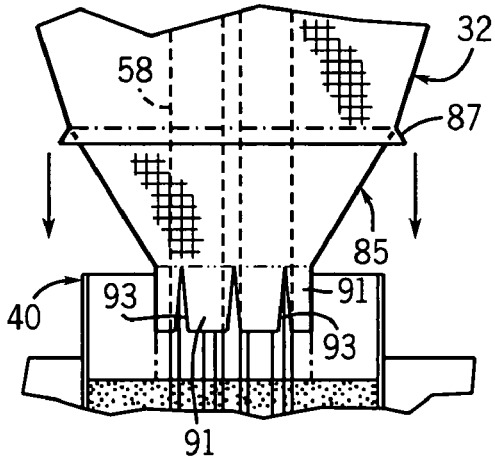
FIG. 8 is a partial side elevation view of the lower end of the screen incorporated in the fiber recovery system illustrated in FIG. 6, with reference to line 8—8 of FIG. 6.

FIGS. 6–8 illustrate an alternative embodiment of a fiber recovery system, shown generally at 30', which is generally similar to fiber recovery system 30 as illustrated and described previously. Like reference characters will be used where possible to facilitate clarity.

In fiber recovery system 30', screen 32 is suspended from frame 34 and has the same general configuration as described previously. In fiber recovery system 30', the white water supply system, shown generally at 38', differs somewhat from white water supply system 38 in that each conduit 58' includes a lower section located below bracket 62, and an upper section 83 which is angled outwardly relative to the lower section. Upper sections 83 of conduits 58' diverge in an upward direction, and each upper section 83 is oriented substantially parallel to the side of screen 32 so that the streams of white water discharged from openings 60 are applied in a substantially perpendicular direction to screen 32. This orientation of conduit upper sections 83 functions to provide a more efficient and direct application of white water to the inside surface of screen 32. Alternatively, the white water may be applied to the inside surface of screen 32 in a non-perpendicular orientation, such that the flow of the white water includes a force component that is parallel to the plane of screen 32 when the white water strikes the surface of screen 32. In the event the white water is applied to the surface of screen 32 so as to include a force component that is parallel to the plane of screen 32, i.e. in a non-perpendicular fashion, the parallel force component of the white water has a tendency to deform the drainage canals of the material of screen 32 from a generally square or rectangular configuration to a diamond-shaped configuration. This deformation of the drainage canals of screen 32 further assists in providing the self-cleaning action of screen 32 by preventing the buildup of material in the corner regions of the drainage canals.

Referring to FIG. 7, each conduit upper section 83 has two lines of openings 60. One of the lines of openings 60 is oriented so as to apply a line of white water streams $S_1$ which is directed outwardly in a radial direction relative to the center of screen 32. Each conduit upper section 83 further includes an additional line of openings 60 that is angled relative to the radially facing line of openings 60. The second line of openings is positioned so as to emit a series of streams $S_2$. Each stream $S_2$ is oriented at an angle of approximately 45° relative to the streams $S_1$, and each stream $S_2$ strikes the inside surface of screen 32 so as to apply a force having both a radial and a tangential component to the inside surface of screen 32. Streams $S_2$ thus function to impart rotation to screen 32 due to the presence of the tangential force component. In addition, the emission of two separate streams from each conduit upper section 83 functions to apply white water throughout a significant portion of the interior surface of screen 32, to maximize the surface area of screen 32 to which white water is applied.

As shown in FIGS. 6 and 8, a lower section 85 is secured to the bottom end of screen 32 at discharge opening 36. Lower section 85 is secured to screen 32 via a skirt 87. Lower section 85 functions to increase the overall screen surface area, and routes usable fiber material inwardly to an outlet 89 at its lower end, which surrounds conduits 58'. At outlet 89, lower section 85 may include a series of flaps 91 separated by slits 93. Usable fibers are discharged into fiber collection tank 38 through slits 93. In operation, fibers are collected on the inside surface of lower section 85, and skirt 87 functions to route waste water outwardly beyond the walls of fiber collection tank 40, to prevent waste water from falling into fiber collection tank 40.

Figure 9:
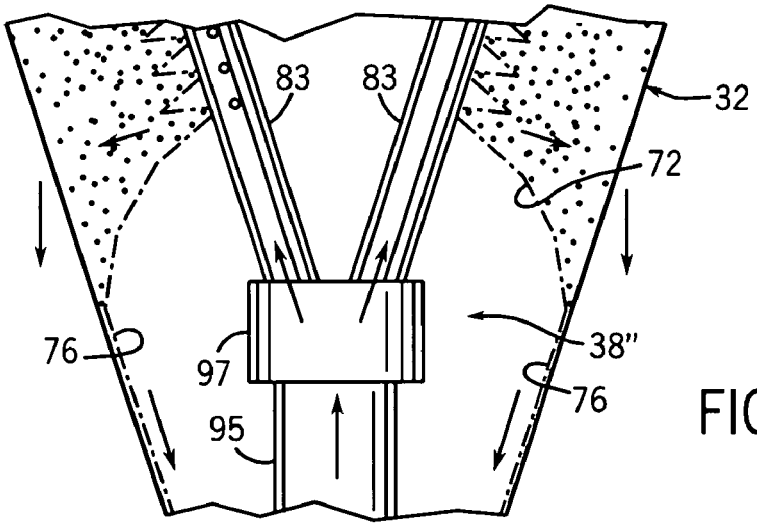
FIG. 9 is an enlarged partial section view illustrating an alternative white water supply arrangement for the fiber recovery system illustrated in FIG. 6.

FIG. 9 illustrates an alternative white water supply system 38", which includes angled upper conduit sections 83 as shown in FIGS. 6 and 7. In this embodiment, white water supply system 38" includes a single supply conduit 95 which extends upwardly into the lower area of screen 32, and supplies white water to a manifold 97 secured to the upper end of conduit 95. Angled upper conduit sections 83 are in turn connected to manifold 97, and receive white water from manifold 97 for application through openings 60 to the inside surface of screen 32 in the manner as described previously. In this embodiment, a single pipe is required to supply white water to the recovery system as opposed to the multiple pipes illustrated in the prior embodiments. With this construction, funnel section 85 can be sized such that its discharge 89 conforms relatively closely to the exterior surface of conduit 95, to further provide additional control for the discharge of usable fibers from funnel section 85.

Figure 9A:
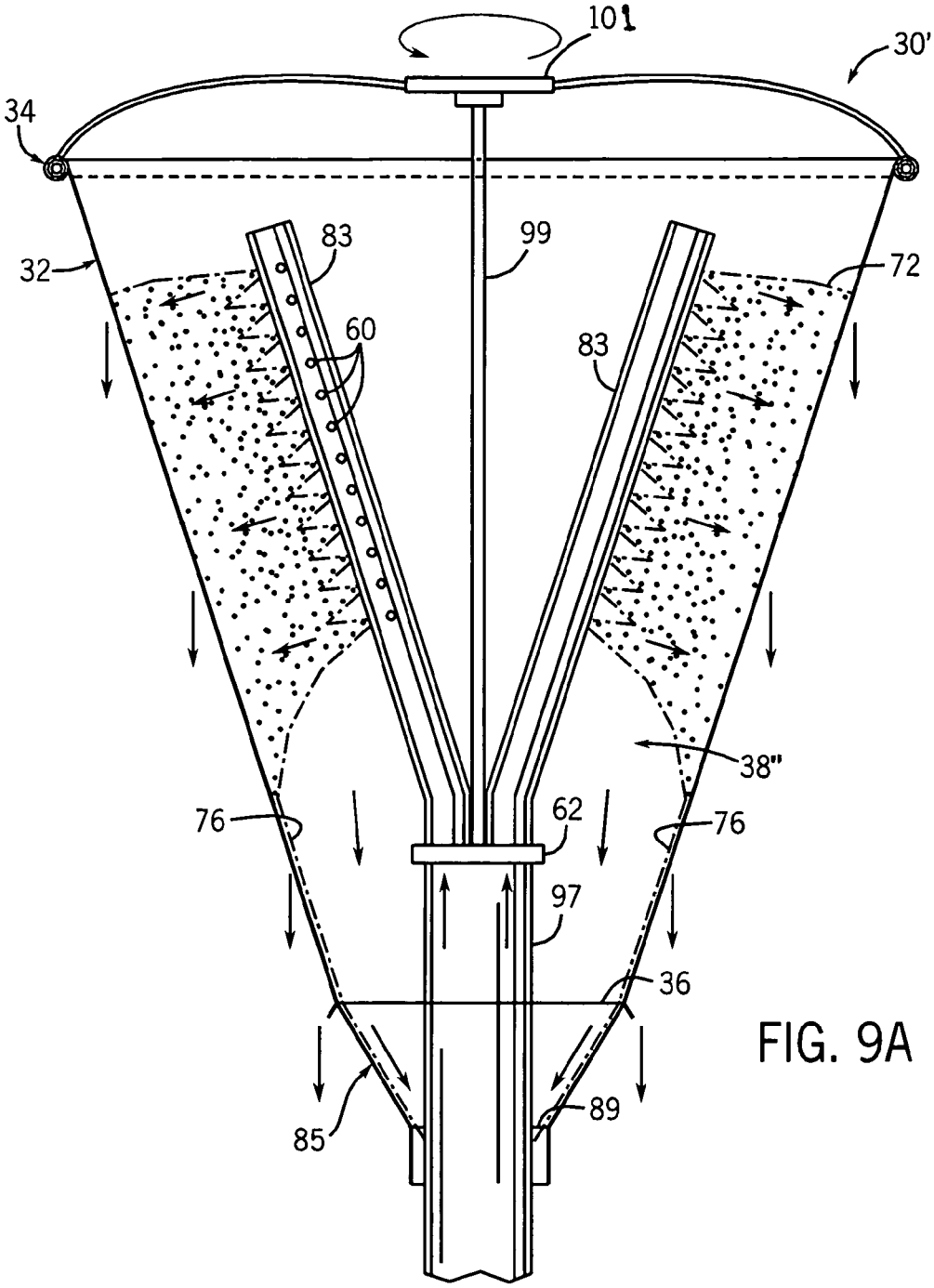
FIG. 9A is a view similar to FIG. 6, showing another alternative embodiment of the fiber recovery system of the present invention, incorporating the white water supply arrangement as illustrated in FIG. 9.

FIG. 9A illustrates a full cross-sectional view of the white water supply system 38" shown in FIG. 9, and also illustrates an alternative system for supporting screen 32. In the embodiment illustrated in FIG. 9A, a vertical support in the form of a mast 99 is located in the interior of screen 32 for rotatably supporting screen 32 from below rather than from above as illustrated in FIGS. 1 and 6. Mast 99 defines a lower end that is mounted to an upwardly facing surface defined by manifold 97, so that screen 32 is supported from manifold 97. A hub 101 is rotatably mounted to the upper end of mast 99, and frame 34 is interconnected with hub 101 by spokes or in any other satisfactory manner. With this construction, the fiber recovery system of the present invention is a generally self-contained system that does not require external support, to enable the system to be produced off-site and then installed on-site simply by making appropriate plumbing connections with the white water, waste water and fiber recovery piping of the tissue or papermaking facility.

FIGS. 10, 11, 12A and 12B illustrate an alternative fiber recovery system in accordance with the present invention, shown generally at 84. In this embodiment, a screen 86 is suspended from a frame 88 having an open discharge end 90. A white water supply conduit 92 directs papermaking white water onto screen 86. A fiber collection tank 94 is located below discharge end 90 of screen 86, and a waste water collection tank 96 is located below the remainder of the length of screen 86.

Frame 88 is generally rectangular in plan, and includes a pair of end frame members 98 and a pair of side frame members 100. Screen 86 is formed of the same type of material as screen 32. Screen 86 has a channel or trough configuration, defining a closed end 102, and a pair of sloped side walls 104 that converge at a trough bottom 106. Screen 86 is oriented such that trough bottom 106 slopes downwardly in a direction toward discharge end 90.

White water supply conduit 92 defines an outlet 108 which directs white water onto the inside surface of screen 86 in the direction of an arrow shown at 110. Outlet 108 of conduit 92 is located toward the discharge end of screen 86, and the pressure of white water within conduit 92 is such that, upon discharge from outlet 108, the white water strikes the inside surfaces of screen 86 at its side wall 104 in close proximity to closed end 102, and is deflected onto closed end 102 and bottom 106.

Figure 12A:
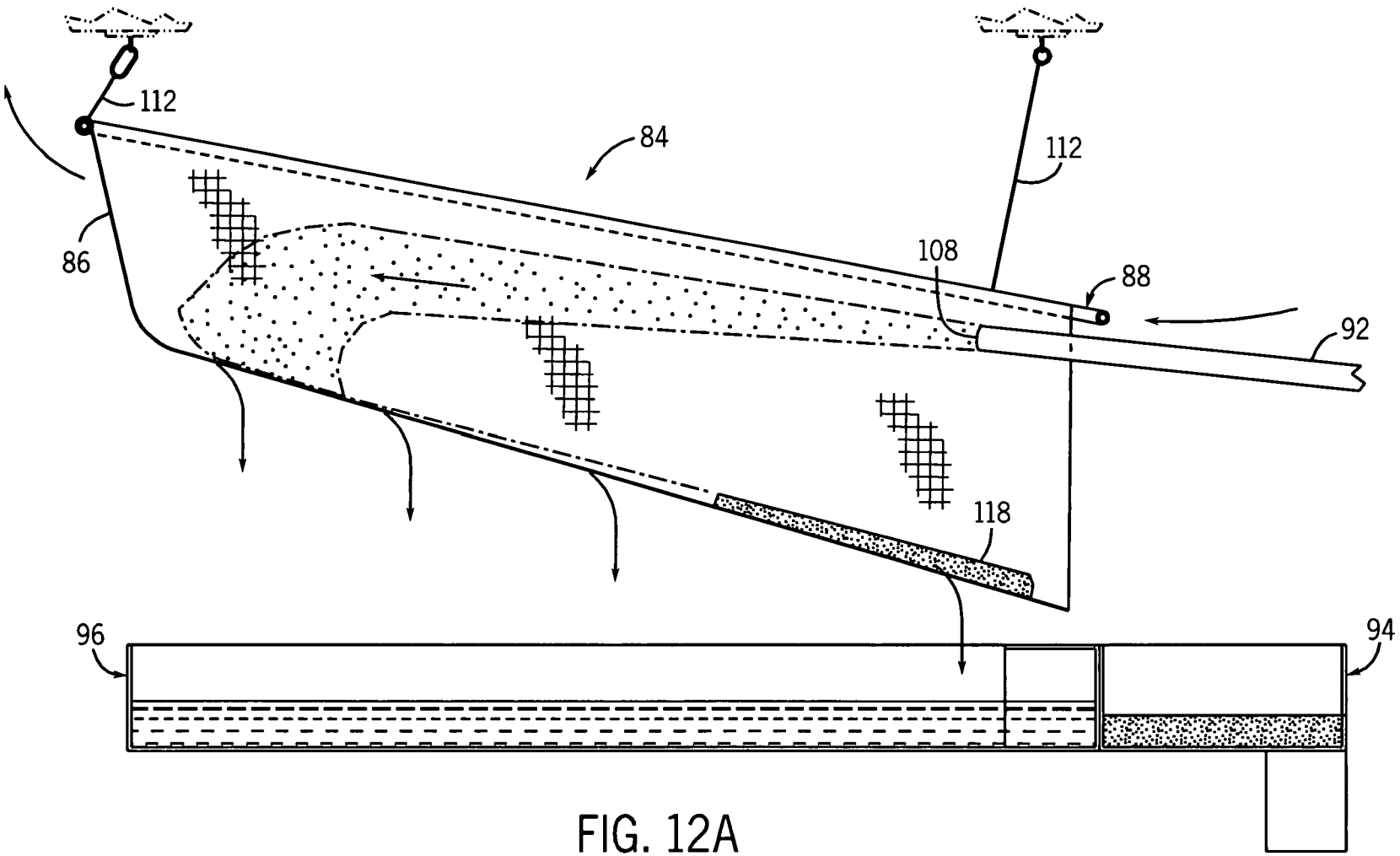
FIGS. 12A and 12B are views similar to FIG. 11, showing the screen being subjected to motion for cleaning of the screen and for discharging collected fibers from the discharge area of the screen.
Figure 12B:
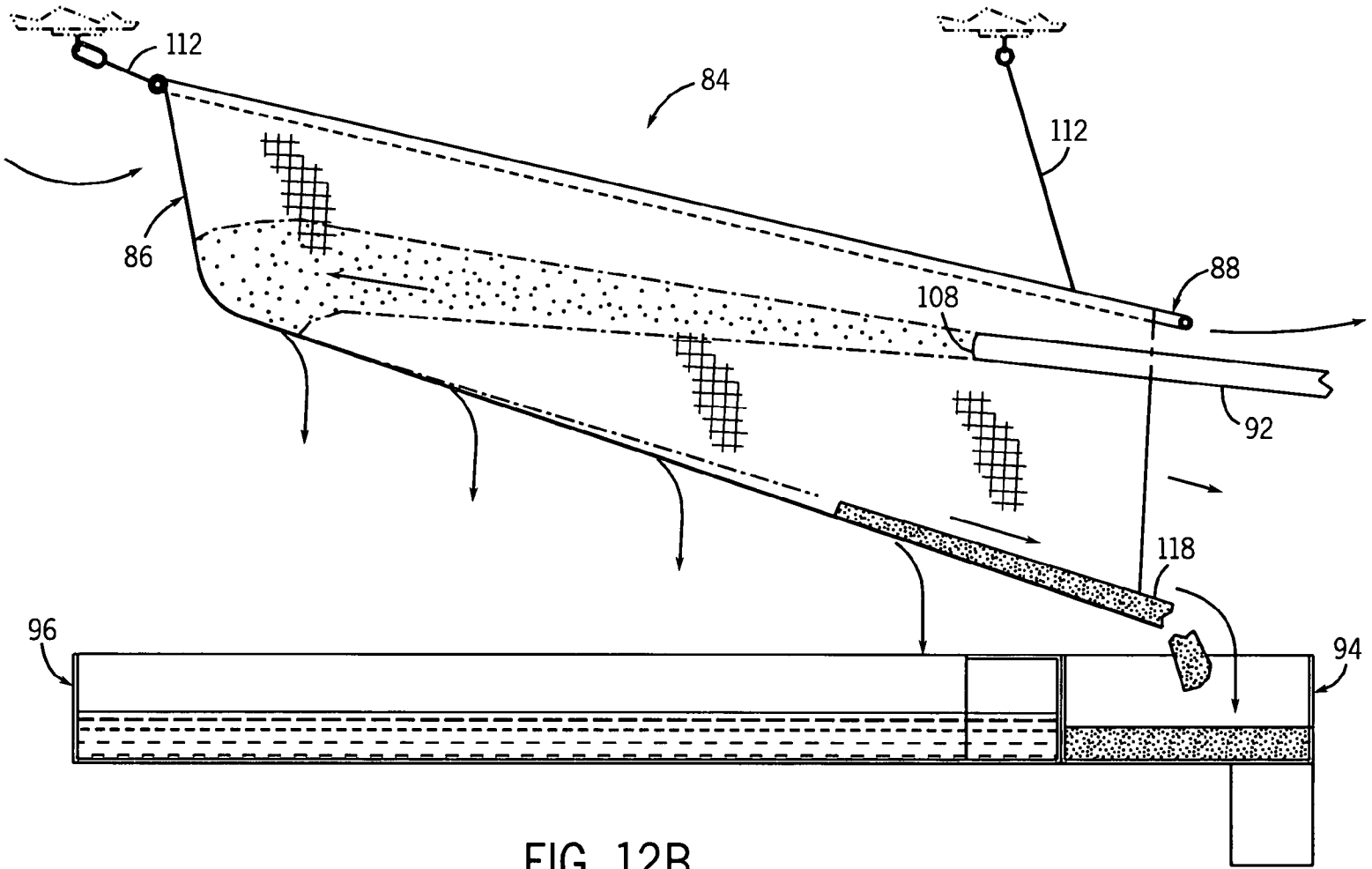

Frame 88 is supported in a manner which allows frame 88 and screen 86 to be movable. In the illustrated embodiment, frame 88 is supported in a suspension-type manner using cables 112 and rings 114, which in turn are connected to suitable upper supports 116. As shown in FIGS. 12A and 12B, frame 88 and screen 86 are adapted to be moved in a longitudinal, axial direction in a back and forth manner, while white water is applied to the inside surfaces of screen 86 through conduit 92.

Figure 11:
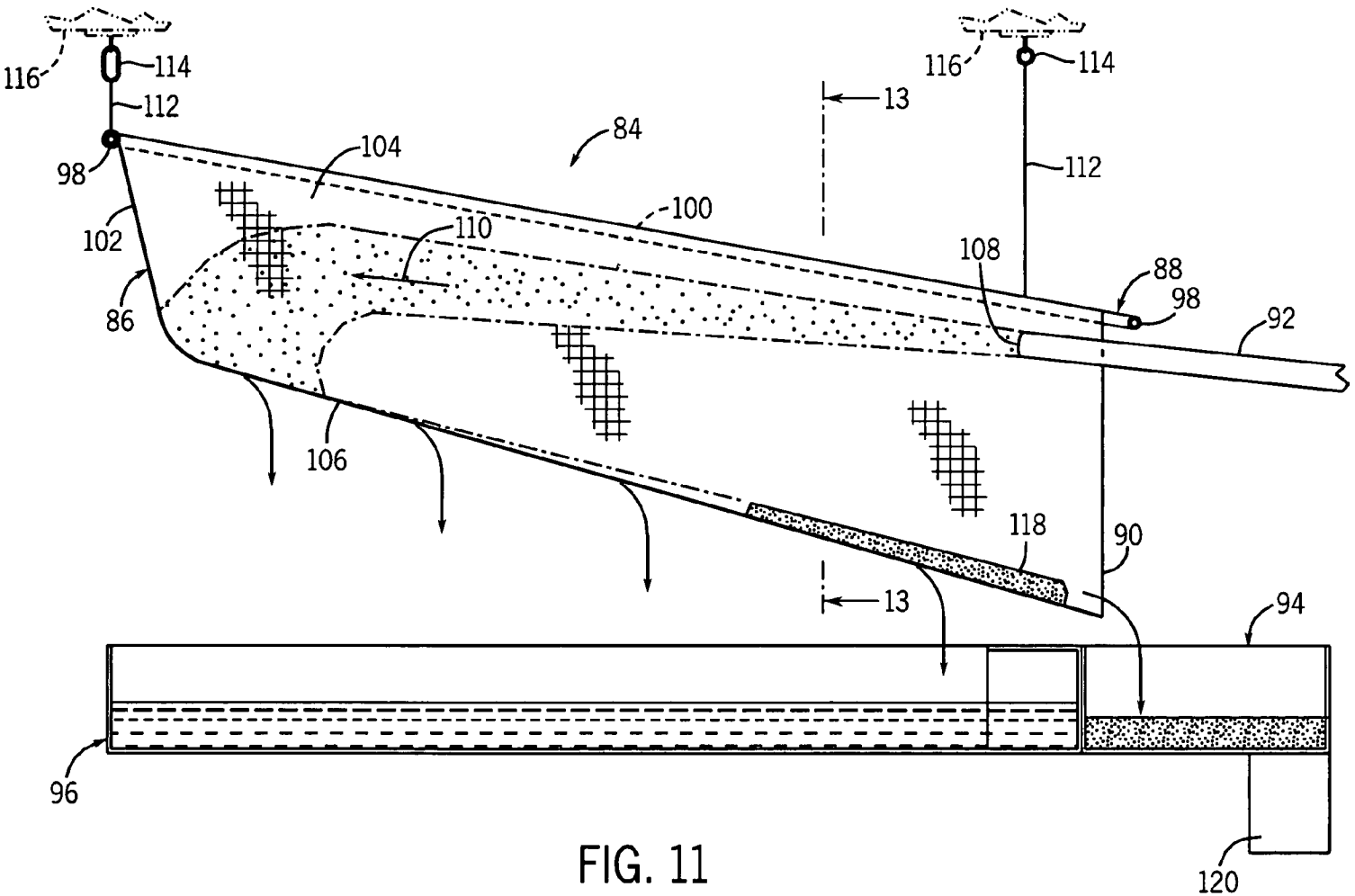
FIG. 11 is a section view taken along line 11—11 of FIG. 10.

In operation, tissue or papermaking white water is applied to the inside surfaces of screen 86 as shown in FIG. 11, through outlet 108 of conduit 92. Again, the openings of screen 86 are sized to retain usable material contained within the white water on the inside surfaces of screen 86. The waste water, including the unusable material such as fines and ash, passes through screen 86 and is collected in waste water collection tank 96. Either intermittently or continuously, screen 86 is moved in a back and forth, axial manner while white water continues to be applied to the inside surfaces of screen 86. The back and forth movement of screen 86 is carried out in any satisfactory manner, preferably in an automated manner by operation of a motor with an intermittent driver, such as a cam-type actuator or the like. To accomplish this, frame 96 is pushed rearwardly to a position as shown in FIG. 12A, and is then allowed to swing forwardly under its own weight, which includes the weight of frame 88, screen 86, and the material retained on screen 86. This movement of screen 86 accomplishes numerous functions. First, the usable fibers, which are collected in the trough of screen 86 on screen bottom 106 and the lower areas of side walls 104, are advanced forwardly toward discharge openings 90 when screen 86 is swung forwardly as shown in FIG. 12B. This causes the endmost portion of the collected fibers, shown at 118, to pass through discharge opening 90 for supply to fiber collection tank 94. In addition, such movement of screen 86 causes the screen material to bend and flex, which provides the self-cleaning action as described above. The screen movement also varies the location at which the white water strikes the inside surfaces of screen 86, which again causes the screen material to locally bend and flex, to self-clean the screen.

As the usable fibers advance toward discharge opening 90, water and undesirable or unusable waste material contained within the white water continues to be separated from the fibers and discharged into waste water collection tank 96. Again, the waste water is routed to a waste water treatment facility for removal of undesirable material, and recirculation of the cleaned water into the system. The collected usable fibers in fiber collection tank 94 are again recirculated into the system through an outlet 120 associated with fiber collection tank 94.

Figure 13:
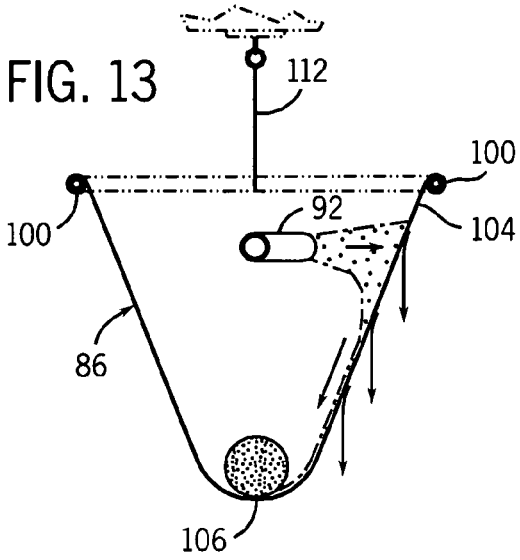
FIG. 13 is a section view taken along line 13—13 of FIG. 11, showing one embodiment for directing the white water onto the screen.
Figure 14:
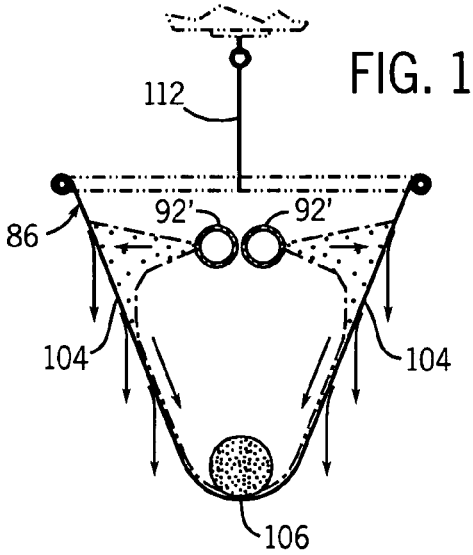
FIGS. 14–18 are views similar to FIG. 13, showing alternative embodiments for directing the white water onto the screen and for imparting motion to the screen.
Figure 15:
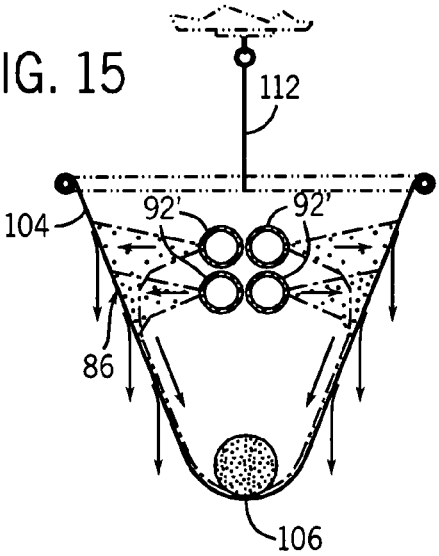

FIG. 13 illustrates a single conduit 92 arranged to direct white water onto a side wall 104 of screen 86. As shown in FIG. 14, it is also contemplated that a pair of conduits 92' may be arranged in a side-by-side manner, and spaced apart linear openings formed in the conduits 92' so as to direct a shower of white water onto the side walls 104 of screen 86. FIG. 15 illustrates the use of four white water supply conduits 92' for directing white water showers onto the side walls 104 of screen 86.

Figure 10:
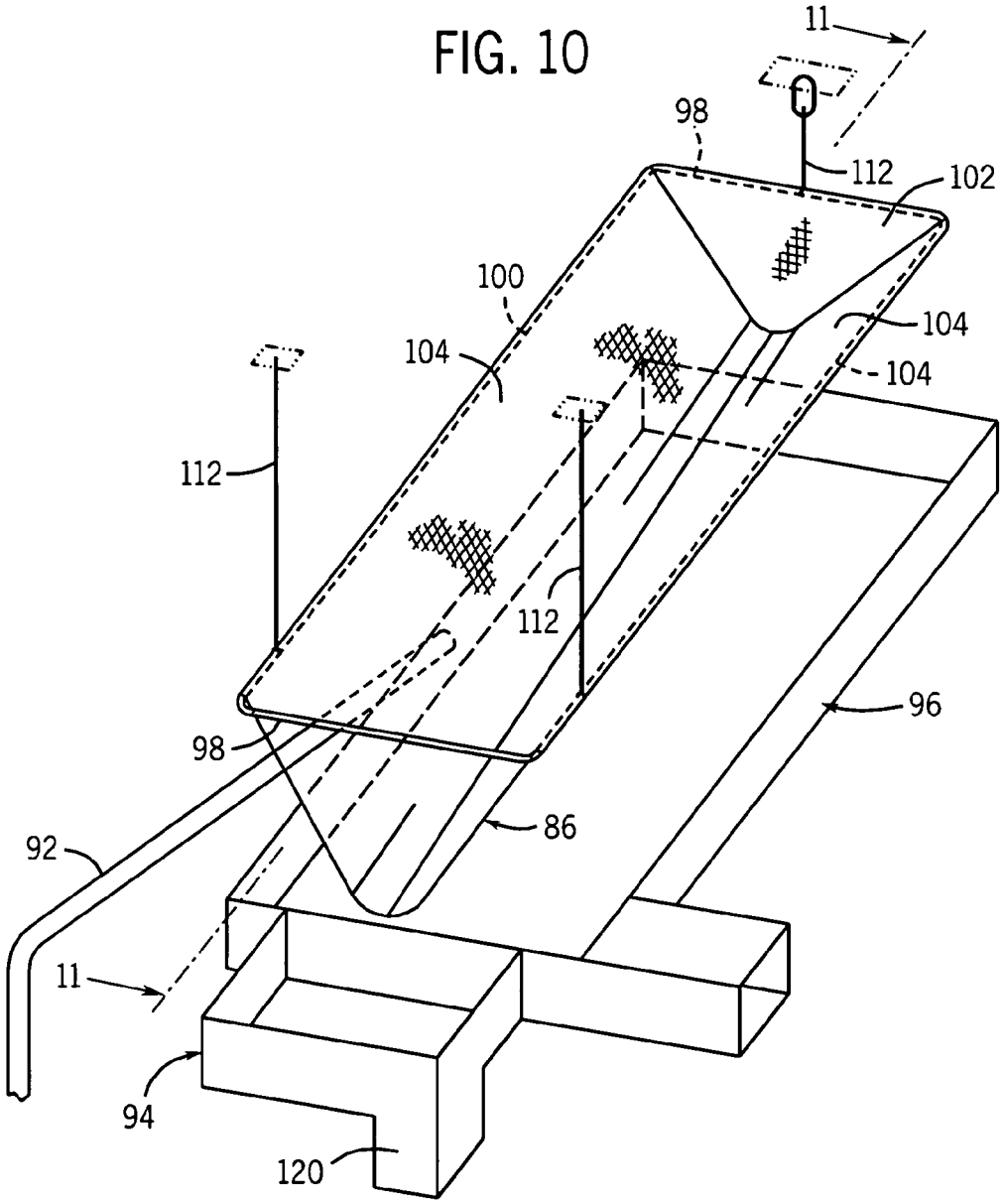
FIG. 10 is an isometric view illustrating another embodiment of a fiber recovery system in accordance with the present invention.
Figure 16:
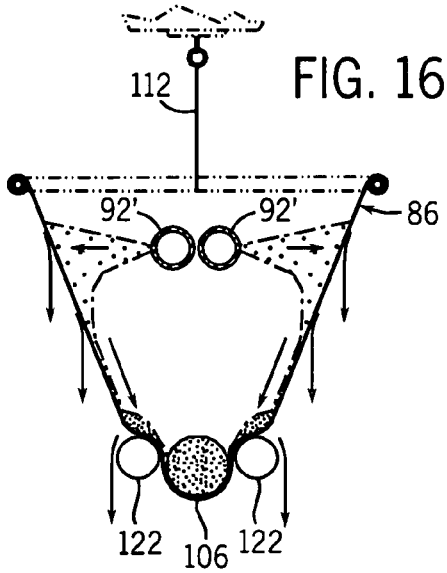

FIG. 16 illustrates an arrangement similar to FIG. 10, but incorporating a pair of bottom frame members 122 which assist in forming the collected fiber material in the bottom area of screen 86.

Figure 17:
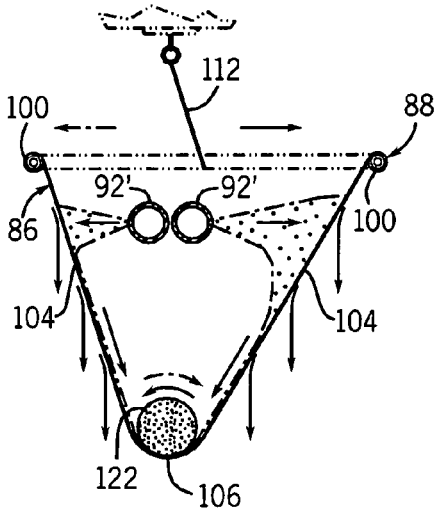

As shown in FIG. 17, it is also contemplated that screen 86 may be moved in a side-to-side manner to provide the same functions as set forth above. Again, this is accomplished by applying a lateral force to frame 88, either continuously or intermittently, to impart movement to screen 86. Such movement of screen 86 functions to roll the collected fibers in the bottom of the trough defined by screen 86, to form a fiber roll or log 122. The downward slope of screen bottom 106 functions to advance fiber roll or log 122 toward discharge outlet 90 as screen 86 is moved in a side-to-side manner.

Figure 18:
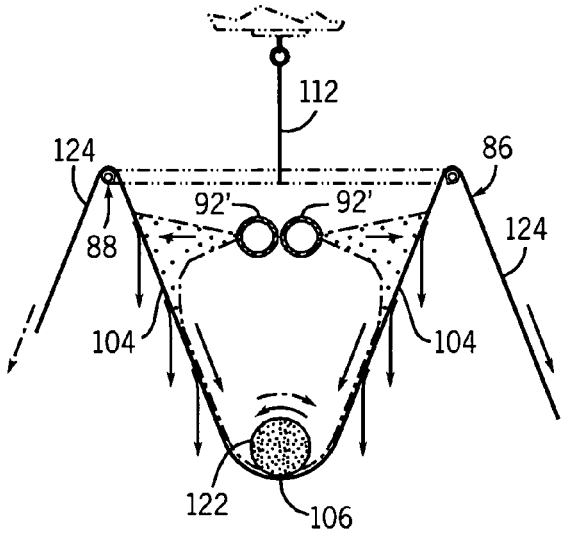

FIG. 18 illustrates another alternative arrangement, in which the side walls 104 of screen 86 are formed with extensions 124. The side wall extensions 124 are alternately extended and retracted, which results in the alternate lengthening and shortening of the screen side walls 104. In this manner, frame 88 twists about its longitudinal axis while screen 86 is moved to vary the location at which the white water strikes screen 86, to flex and self-clean screen 86, and to advance fiber roll or log 122 towards screen discharge outlet 90.

Figure 19:
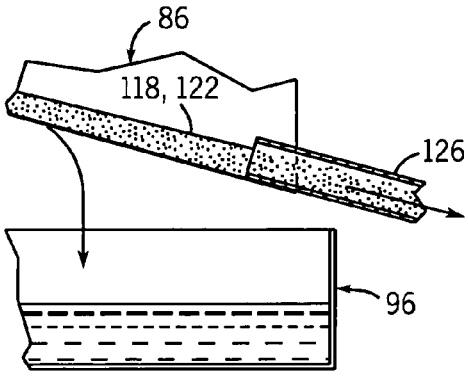
FIGS. 19 and 20 are partial side elevation views illustrating two different discharge arrangements for a screen configured as shown in FIG. 11.

FIG. 19 illustrates an arrangement in which a fiber discharge conduit 126 is located at the discharge outlet 90 of screen 86. The usable fibers advanced toward discharge outlet 90 are routed directly into the inlet of fiber discharge conduit 126, to eliminate the use of fiber collection tank 94 and to route the usable fibers directly back into the papermaking process.

Figure 20:
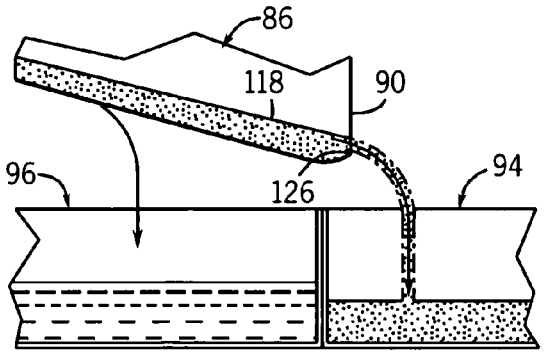

FIG. 20 illustrates the use of a rigid frame member 126 located at discharge outlet 90 of screen 86. This arrangement functions to create a fiber collection pocket at the bottom end of screen 86 adjacent discharge outlet 90, to form a dam over which the collected fiber material is discharged.

Figure 21:
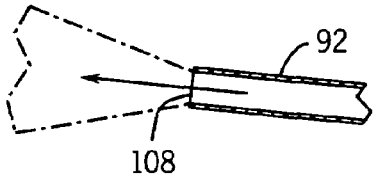
FIG. 21 is a view illustrating the discharge area of the supply conduit which directs the white water onto the screen in an embodiment such as illustrated in FIG. 10.
Figure 22:
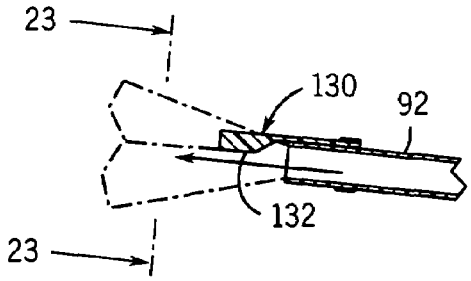
FIG. 22 is a view similar to FIG. 21, showing a flow deflector at the discharge of the supply conduit.
Figure 23:
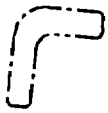
FIG. 23 is a section view taken along line 23—23 of FIG. 22.
Figure 24A:
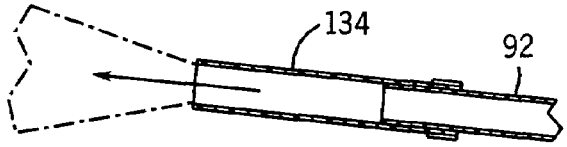
FIGS. 24A and 24B are views similar to FIG. 21, showing alternative arrangements at the discharge of the supply conduit for altering the path of the white water as it is directed toward the screen.
Figure 24B:
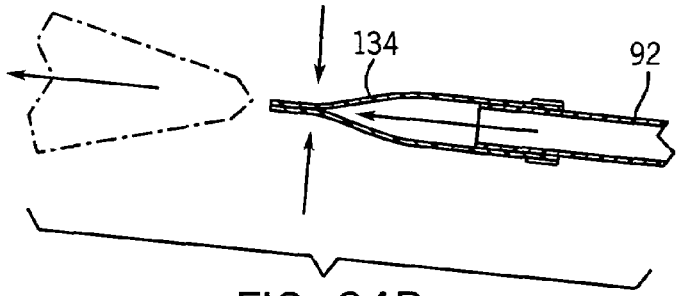

FIG. 21 shows white water supply conduit 92 having outlet 108 through which the stream of white water is discharged for application to the inside surfaces of screen 86. It is also contemplated that the location at which the white water impinges upon screen 86 can be varied by varying the location of the flow rather than varying the position of the screen. In this regard, as shown in FIG. 22, a flow deflector 130 may be mounted to conduit 92, having a fin 132 located in the white water flow path. Fin 132 is configured to move in response to the impingement of white water onto fin 132, to move the white water flow as it is directed toward screen 86. FIGS. 24A and 24B illustrate a flexible nozzle 134 mounted to the end of conduit 92. Nozzle 134 is formed of a flexible material such as rubber, and functions to move upwardly and downwardly in response to the emission of white water through its outlet so as to vary the location at which the white water impinges upon the inside surfaces of screen 86.

Figure 25:
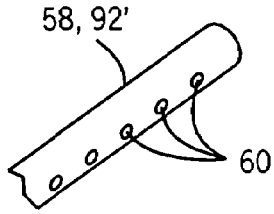
FIGS. 25–27 are views illustrating different opening configurations for a supply conduit, for use in directing the white water onto the screen.
Figure 26:
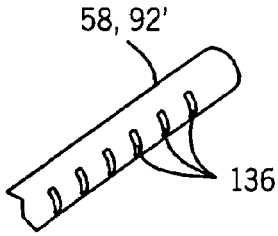
Figure 27:
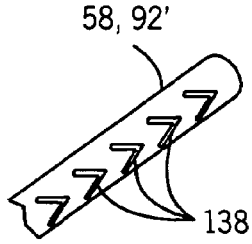

FIG. 25 illustrates white water supply conduits such as 58 or 92', having spaced openings 60 for providing a white water shower onto the inside surfaces of a screen, such as 32 or 86. Openings 60 are illustrated as being circular. As shown in FIG. 26, the openings may also be in the form of straight transverse slots 136, or, as shown in FIG. 27, in the form of V-shaped slots 138, to provide different shower configurations for applying the white water to the screen.

It is understood that additional variations and alternatives are possible for the system and details illustrated in FIGS. 11–27. For example, and without limitation, the particular shape and configuration of the screen may vary from the illustrated embodiment. Frame 88 may take any desired shape, and may be supported in any satisfactory manner. The white water may be applied to the screen using the various illustrated white water supply arrangements, or any other arrangement as desired. While the screen is shown and described as being movable either axially or transversely, it is understood that a combination of axial and transverse movement may also be employed. In addition, it is understood that the present invention may be employed to screen any type of fluid-borne particles, and is not limited to use in a tissue or papermaking white water screening application.

Figure 28:
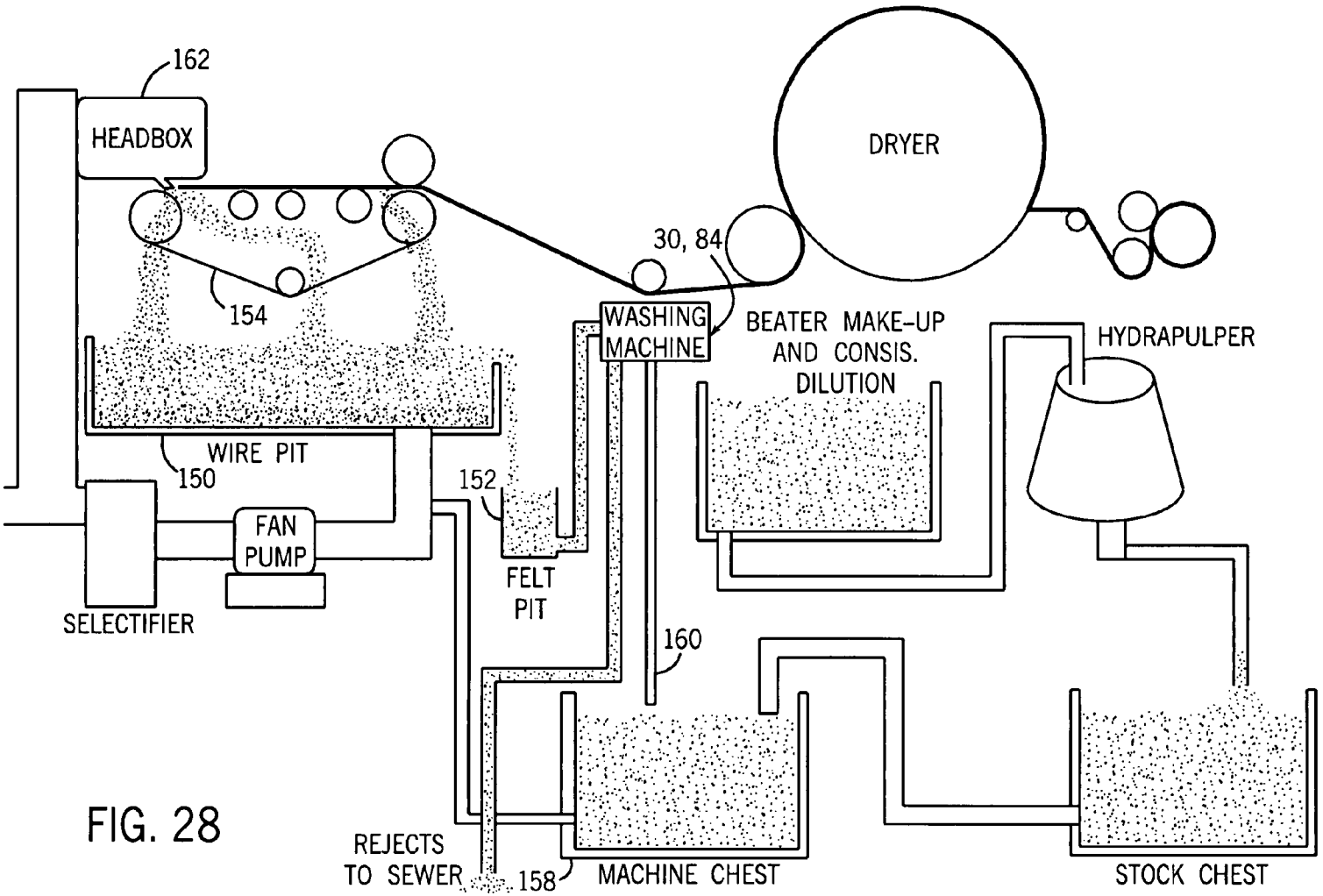
FIG. 28 is a schematic representation of a papermaking process incorporating the fiber recovery system of the present invention.
Figure 29:
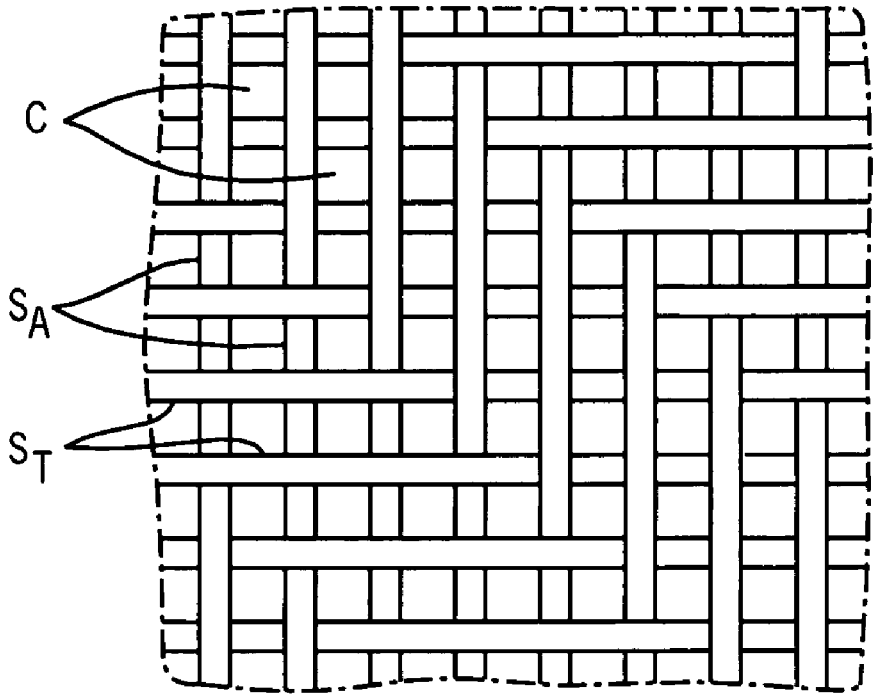
FIG. 29 is an elevation view of the screen material used to form the screen incorporated into the fiber recovery system of the present invention.
Figure 30:
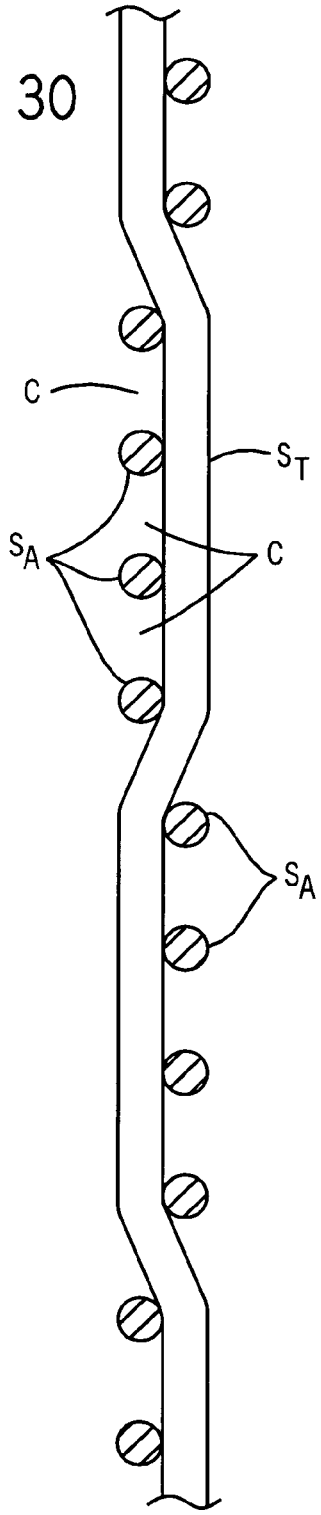
FIG. 30 is a cross-sectional view of the screen material shown in FIG. 29.

FIG. 28 illustrates a representative tissue or papermaking system in which the fiber recovery system of the present invention, shown at 30 and 84, may be incorporated. As shown, fiber recovery system 30, 84 is located downstream of the wire pit 150 and felt pit 152, which collects white water discharged through the fabric 154. The recovered fiber material is supplied to the machine chest 158 through an appropriate supply pipe 160, which supplies the recovered fibers into the supply stream for ultimate supply to the head box 162 of the tissue or papermaking machine. It is understood that any number of fiber recovery systems such as 30, 84 may be used according to the size of the tissue or papermaking system and the volume of white water produced in the system, to recover all of the usable fibers contained in the white water and to purge the system of small particulate material such as fines and ash.

Figure 31:
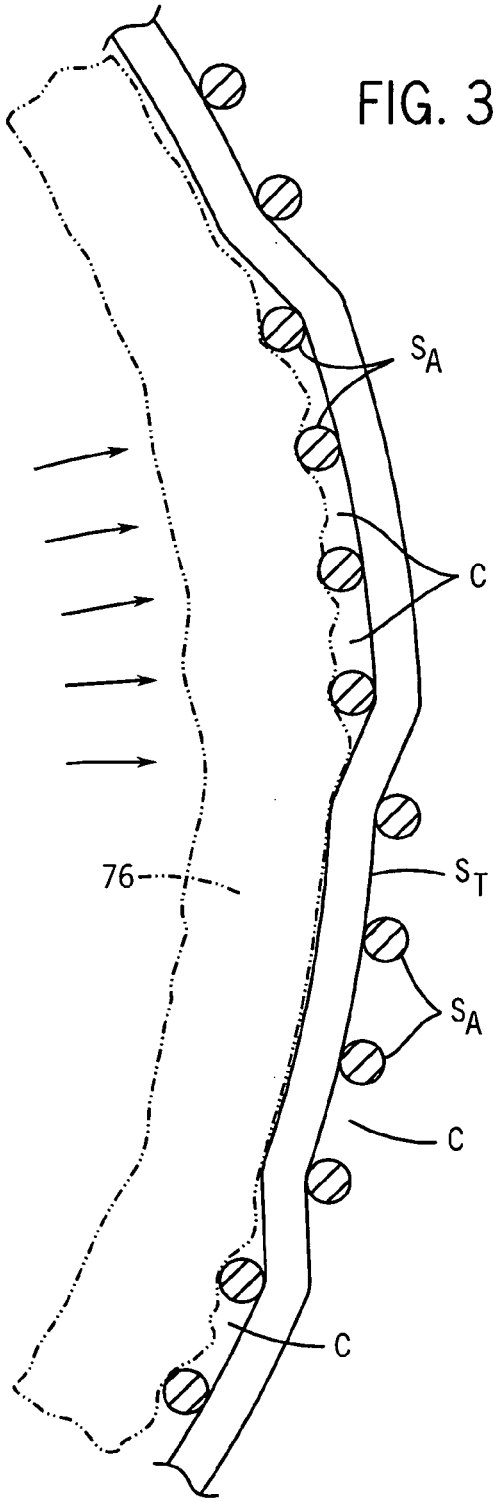
FIG. 31 is a view similar to FIG. 30, showing the screen material in a deformed or arcuate configuration such as occurs when white water is directed onto the screen in operation.
Figure 32:
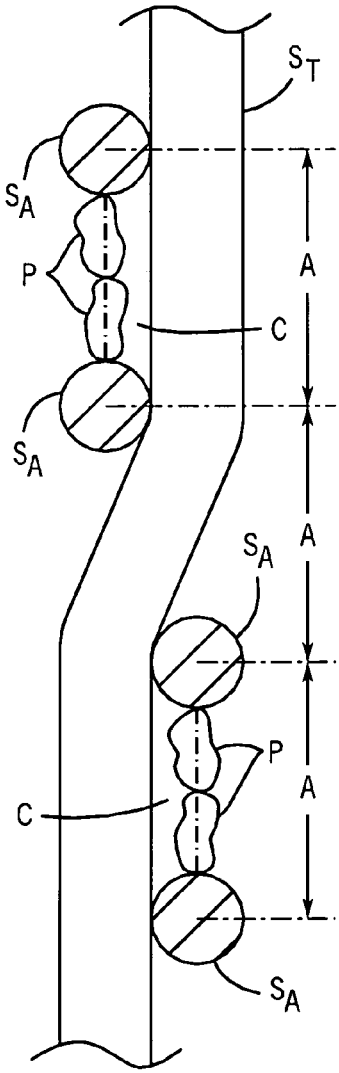
FIG. 32 is an enlarged cross-sectional view of a portion of the screen material as illustrated in FIG. 30.
Figure 33:
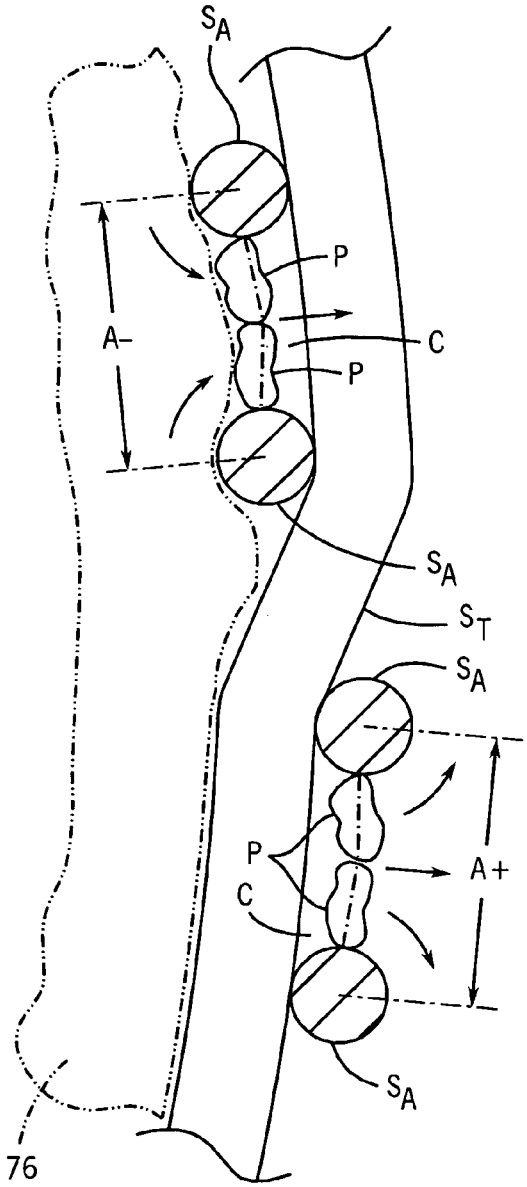
FIG. 33 is an enlarged cross-sectional view of a portion of the screen material as illustrated in FIG. 31.

FIGS. 29–33 illustrate a representative embodiment of the material used to construct screens 32 and 86. As noted previously, the screen material may be a five shed tissue making screen material, although it is understood that any other screen material configuration may be employed. The screen material includes axial strands $S_A$ and transverse strands $S_T$, which are woven together in a known manner and which cooperate to define generally rectangular drainage openings or canals C that extend throughout the thickness of the screen material. The screen material is selected so that the dimensions of canals C allow the fines and ash material contained within the white water to pass through canals C, and to retain the usable fibers contained in the white water on the inside surface of the screen material in fiber layer 76. As shown in FIGS. 31 and 33, the fiber layer 76 is formed on the inside surface of the screen material such that the area of fiber layer 76 that overlies each canal C extends partially into the canal C. This outward formation of fiber layer 76 into canals C functions to anchor fiber layer 76 onto the screen material. As the area of the screen material is subjected to outward pressure, such as when the area of the screen material passes through the area at which the white water showers are located, the pressure of the applied white water functions to disrupt the individual fibers of the fiber layer 76 as well as the anchor of the fiber layer 76 onto the screen material, which enables fiber layer 76 to move downwardly on the screen material toward the screen discharge area. Simultaneously, the outward pressure applied to the screen material functions to deflect or deform the screen material outwardly, as noted previously, to increase the degree of curvature of the screen material. Such outward deflection or deformation of the screen material causes the flexing action of the screen as noted above, which creates an alteration in the shape of the drainage canals C. This results in the self-cleaning function of the screen material, in that the alteration in the shape of the drainage canals C prevents the build-up of fines and ash material in the corners of drainage canals C. FIGS. 32 and 33 illustrate this action. As shown in FIG. 32, particles P of fines and ash material tend to become trapped between the strands of the screen material when the screen material is in a flat or slightly curved configuration, such as between the areas where the showers of white water are applied to the interior of the screen material. When the white water showers are applied to the screen material, the screen material is deflected outwardly to increase the curvature of the screen material and to simultaneously subject the inside surface of the screen material and fiber layer 76 to the pressure of the applied shower. Such outward deflection of the screen material alters the surfaces of the strands that defines the drainage canals C to loosen any particles P that may be caught within a drainage canal C between adjacent strands. As shown in FIGS. 32 and 33, the strands of the screen material are normally separated by a space designated A. As the screen material is flexed, the inside strands move slightly together to a spacing shown at A−, and the outside strands are moved slightly apart to a spacing shown at A+. Such movement of the strands together and apart functions to dislodge particles from the comers of the drainage canals C, and the dislodged particles are subjected to the pressure of the white water shower or to the pressure applied by the shower to the fibers incorporated into the fiber layer 76, to force the dislodged particles outwardly for discharge from the drainage canals C. This action prevents particles such as P from building up between the strands, to prevent plugging of the drainage canals C and to thus eliminate the downtime and extra equipment required for cleaning screen equipment as is required by the prior art.

After the material of the screen moves past the location of outward deflection, such as is caused by application of the white water showers to the inside surface of the screen, the screen with the fiber layer 76 applied to the inside surface assumes a flat or less curved configuration. Fiber layer 76 tends to retain the greater curvature due to the interlocking of the fibers at the time the fiber layer is formed, such that the flattening of the material of the screen thus functions to dislodge the fiber layer 76 from the screen material. In this manner, the fiber layer 76 is able to move by gravity relative to the inside surface of the screen material toward the screen discharge area when the screen material is located between the shower application areas.

If necessary, the screen may be backflushed occasionally as desired, such as by application of air or water to the outside of the screen, in order to clean the screen as needed.

Various alternatives and embodiments are contemplated as being within the scope of the following claims particularly pointing out and distinctly claiming the subject matter regarded as the invention.

I claim:

1. A system for separating fluid-borne material from a fluid that carries particulate matter along with the material, comprising:

a screen arrangement including a support and a screen suspended from the support, wherein the screen defines an interior and an outlet, and is constructed of a flexible and pliable screen material formed of a series of interwoven strands that define drainage passages;

a fluid supply arrangement configured to direct the fluid outwardly from within the interior of the screen onto the inner surface of the screen, wherein the fluid impinges on the inner surface of the screen at one or more impingement locations, and wherein the screen is configured to deflect outwardly at the one or more impingement locations, wherein the drainage passages are sized to retain the material on an inner surface defined by the screen and to allow the particulate matter to pass through the drainage passages; and means interconnected with the support for imparting movement to the screen through the support, wherein movement of the screen varies the one or more impingement locations while the fluid is directed outwardly onto the inside surface of the screen by the fluid supply arrangement;

wherein the outward deflection of the screen upon movement of the screen past the one or more impingement locations functions to vary the configuration of the drainage passages to dislodge any particulate matter located within the drainage passages, and wherein pressure applied by the fluid supply arrangement at the one or more impingement locations functions to force the particulate matter located within the drainage passages through the drainage passages so as to prevent buildup of particulate matter within the drainage passages.

2. The system of claim 1, wherein the support comprises a frame arrangement, wherein the frame arrangement is interconnected with an upper end defined by the screen and wherein the screen defines a lower area located below the frame arrangement that is unsupported.

3. The system of claim 2, wherein the screen defines a conical configuration having an upper end connected to the frame arrangement and a lower end defining the outlet.

4. The system of claim 3, wherein the means for imparting movement to the screen comprises means for rotating the frame arrangement about a generally upright axis of rotation coincident with a longitudinal axis defined by the screen.

5. The system of claim 4, wherein the fluid supply arrangement comprises a conduit arrangement located within the interior defined by the screen, wherein the conduit arrangement includes a series of openings through which the fluid is applied to the inside surface of the screen.

6. The system of claim 5, wherein the openings in the conduit arrangement are configured and arranged to apply a force to the inside surface of the screen tending to impart rotation to the screen about the axis of rotation of the frame arrangement.

7. The system of claim 2, wherein the frame arrangement and the screen are configured such that the screen is suspended from the frame and defines an upwardly open trough having an open end defining the outlet of the screen.

8. The system of claim 7, wherein the means for imparting movement to the screen comprises means for varying the location at which the fluid is directed onto the screen.

9. The system of claim 8, wherein the fluid supply arrangement includes a conduit having an end through which the fluid is discharged, and further comprising a discharge member interconnected with the end of the conduit for varying the flow of the fluid and the location at which the fluid strikes the screen.

10. The system of claim 7, wherein the means for imparting movement to the screen comprises means for moving the frame arrangement so as to impart movement to the screen as the fluid is directed onto the surface of the screen.

11. The system of claim 10, wherein the means for imparting movement to the screen is operable to move the screen in a direction transverse to a longitudinal axis defined by the trough, wherein transverse movement of the screen is operable to roll the material in the trough.

12. The system of claim 11, wherein the frame arrangement and the screen are configured such that the trough defines a downwardly angled lower surface leading toward the outlet, to assist in directing the material toward the outlet upon movement of the screen.

13. The system of claim 11, wherein the screen is movable in an axial direction along a longitudinal axis defined by the trough.

14. The system of claim 13, wherein the frame arrangement and the screen are configured such that the trough defines a downwardly angled lower surface leading toward the outlet, to assist in directing the usable fibers toward the open end upon movement of the screen.

15. A system for separating fluid-borne material from a fluid that carries particulate matter along with the material, comprising:

a screen arrangement including a support and a screen suspended from the support, wherein the screen defines an interior and an outlet, and is constructed of a flexible and pliable screen material formed of a series of interwoven strands that define drainage passages, wherein the support comprises a frame arrangement, wherein the frame arrangement is interconnected with an upper end defined by the screen and wherein the screen defines a lower area located below the frame arrangement that is unsupported;

a fluid supply arrangement configured to direct the fluid outwardly from within the interior of the screen onto the inner surface of the screen, wherein the fluid impinges on the inner surface of the screen at one or more impingement locations, and wherein the screen is configured to deflect outwardly at the one or more impingement locations, wherein the drainage passages are sized to retain the material on an inner surface defined by the screen and to allow the particulate matter to pass through the drainage passages; and means interconnected with the support for imparting movement to the screen, wherein movement of the screen varies the one or more impingement locations while the fluid is directed outwardly onto the inside surface of the screen by the fluid supply arrangement;

wherein the outward deflection of the screen upon movement of the screen past the one or more impingement locations functions to vary the configuration of the drainage passages to dislodge any particulate matter located within the drainage passages, and wherein pressure applied by the fluid supply arrangement at the one or more impingement locations functions to force the particulate matter located within the drainage passages through the drainage passages so as to prevent buildup of particulate matter within the drainage passages.

16. The system of claim 15, wherein the screen defines a conical configuration having an upper end connected to the frame arrangement and a lower end defining the outlet.

17. The system of claim 16, wherein the means for imparting movement to the screen comprises means for rotating the frame arrangement about a generally upright axis of rotation coincident with a longitudinal axis defined by the screen.

18. The system of claim 17, wherein the fluid supply arrangement comprises a conduit arrangement located within the interior defined by the screen, wherein the conduit arrangement includes a series of openings through which the fluid is applied to the inside surface of the screen.

19. The system of claim 18, wherein the openings in the conduit arrangement are configured and arranged to apply a force to the inside surface of the screen tending to impart rotation to the screen about the axis of rotation of the frame arrangement.

20. The system of claim 15, wherein the frame arrangement and the screen are configured such that the screen is suspended from the frame and defines an upwardly open trough having an open end defining the outlet of the screen.

21. The system of claim 20, wherein the means for imparting movement to the screen comprises means for varying the location at which the fluid is directed onto the screen.

22. The system of claim 21, wherein the fluid supply arrangement includes a conduit having an end through which the fluid is discharged, and further comprising a discharge member interconnected with the end of the conduit for varying the flow of the fluid and the location at which the fluid strikes the screen.

23. The system of claim 20, wherein the means for imparting movement to the screen comprises means for moving the frame arrangement so as to impart movement to the screen as the fluid is directed onto the surface of the screen.

24. The system of claim 23, wherein the means for imparting movement to the screen is operable to move the screen in a direction transverse to a longitudinal axis defined by the trough, wherein transverse movement of the screen is operable to roll the material in the trough.

25. The system of claim 24, wherein the frame arrangement and the screen are configured such that the trough defines a downwardly angled lower surface leading toward the outlet, to assist in directing the material toward the outlet upon movement of the screen.

26. The system of claim 24, wherein the screen is movable in an axial direction along a longitudinal axis defined by the trough.

27. The system of claim 26, wherein the frame arrangement and the screen are configured such that the trough defines a downwardly angled lower surface leading toward the outlet, to assist in directing the usable fibers toward the open end upon movement of the screen.

28. A method of separating fluid-borne material from a fluid that carries particulate matter along with the material, comprising the steps of:

directing the fluid onto a surface of a flexible screen, wherein the screen defines drainage passages sized to retain the material on the surface of the screen and wherein the drainage passages allow fluid and particulate matter contained within the fluid to pass through the screen, wherein the screen is supported by a support arrangement that is configured to provide outward deflection of the screen where the fluid is directed onto the surface of the screen; and causing movement of the screen by movement of the support while directing the fluid onto the surface of the screen so as to vary the location at which the fluid is directed onto the surface of the screen, wherein the movement of the screen combined with the outward deflection of the screen is operable to alter the configuration of the drainage passages of the screen to dislodge particulate matter contained within the drainage passages, wherein pressure applied to the surface of the screen by the fluid is operable to force particulate matter contained within the drainage passages through the drainage passages to prevent buildup of particulate matter within the screen passages.

29. The method of claim 28, further comprising the step of collecting the material from a discharge area defined by the screen.

30. The method of claim 29, wherein the step of causing movement of the flexible screen is carried out by varying the location at which the fluid is directed onto the surface of the screen.

31. The method of claim 29, wherein the step of causing movement of the flexible screen through the support is carried out by imparting movement to the screen through a frame arrangement from which the screen is suspended.

32. The method of claim 31, wherein the screen is configured to define a conical shape having an open lower end defining the discharge area of the screen and wherein the frame arrangement is located at an upper end defined by the screen, and wherein the step of directing the fluid onto the surface of the screen is carried out by directing the fluid outwardly toward an inner surface defined by the screen from a location within an interior defined by the screen.

33. The method of claim 32, wherein the step of imparting movement to the screen is carried out by rotating the frame arrangement while the fluid is directed onto the inner surface of the screen.

34. The method of claim 33, wherein the step of imparting rotation to the screen is carried out by directing the fluid tangentially against the inner surface of the screen.

35. The method of claim 31, wherein the screen is suspended from the frame arrangement and wherein the screen and the frame arrangement are configured such that the screen defines a trough configuration having an open end defining the discharge area of the screen, and wherein the step of directing the fluid onto the surface of the screen is carried out by applying the fluid to side areas defined by the trough configuration of the screen.

36. The method of claim 35, wherein the step of imparting movement to the screen through movement of the support is carried out by moving the frame arrangement transversely relative to the longitudinal axis defined by the trough of the screen.

37. The method of claim 36, further comprising the step of orienting the screen so that the trough of the screen defines a downwardly angled lower wall leading to the open end of the screen, for assisting and directing the material to the discharge area of the screen.

38. The method of claim 35, wherein the step of imparting movement to the screen through movement of the support is carried out by moving the frame arrangement in an axial direction relative to a longitudinal axis defined by the trough of the screen.

39. The method of claim 38, further comprising the step of orienting the screen so that the trough of the screen defines a downwardly angled lower wall leading to the open end of the screen, for assisting in directing material to the discharge area of the screen.

40. A method of separating fluid-borne material from a fluid that carries particulate matter along with the material, comprising the steps of:

directing the fluid onto a surface of a flexible screen, wherein the screen defines drainage passages sized to retain the material on the surface of the screen and wherein the drainage passages allow fluid and particulate matter contained within the fluid to pass through the screen, wherein the screen is supported by a support arrangement that is configured to provide outward deflection of the screen where the fluid is directed onto the surface of the screen;

causing movement of the screen while directing the fluid onto the surface of the screen so as to vary the location at which the fluid is directed onto the surface of the screen, wherein the movement of the screen combined with the outward deflection of the screen is operable to alter the configuration of the drainage passages of the screen to dislodge particulate matter contained within the drainage passages, wherein pressure applied to the surface of the screen by the fluid is operable to force particulate matter contained within the drainage passages through the drainage passages to prevent buildup of particulate matter within the screen passages;

wherein the step of causing movement of the flexible screen is carried out by varying the location at which the papermaking fluid is directed onto the surface of the screen, wherein the step of varying the location at which the fluid is directed onto the surface of the screen is carried out by discharging the fluid through a pliable discharge member interconnected with a rigid conduit, wherein the pliable discharge member defines an outlet which is movable in response to the discharge of fluid therethrough; and collecting the material from a discharge area defined by the screen.

41. A method of separating fluid-borne material from a fluid that carries particulate matter along with the material, comprising the steps of:

directing the fluid onto a surface of a flexible screen, wherein the screen defines drainage passages sized to retain the material on the surface of the screen and wherein the drainage passages allow fluid and particulate matter contained within the fluid to pass through the screen, wherein the screen is supported by a support arrangement that is configured to provide outward deflection of the screen where the fluid is directed onto the surface of the screen;

causing movement of the screen by movement of the support while directing the fluid onto the surface of the screen so as to vary the location at which the fluid is directed onto the surface of the screen, wherein the movement of the screen combined with the outward deflection of the screen is operable to alter the configuration of the drainage passages of the screen to dislodge particulate matter contained within the drainage passages, wherein pressure applied to the surface of the screen by the fluid is operable to force particulate matter contained within the drainage passages through the drainage passages to prevent buildup of particulate matter within the screen passages, wherein the step of causing movement of the flexible screen is carried out by imparting movement to the screen through a frame arrangement from which the screen is suspended; and collecting the material from a discharge area defined by the screen;

wherein the screen is configured to define a conical shape having an open lower end defining the discharge area of the screen and wherein the frame arrangement is located at an upper end defined by the screen, and wherein the step of directing the fluid onto the surface of the screen is carried out by directing the fluid outwardly toward an inner surface defined by the screen from a location within an interior defined by the screen; and wherein the step of imparting movement to the screen is carried out by rotating the frame arrangement while the fluid is directed onto the inner surface of the screen.

42. The method of claim 41, wherein the step of rotating the frame arrangement is carried out by directing the fluid tangentially against the inner surface of the screen.

43. A fiber recovery system for use in recovering usable fibers contained in papermaking fluid, comprising:

flexible screen means defining openings sized to prevent the passage of usable fibers therethrough, the flexible screen means defining a discharge area, wherein the flexible screen means defines an interior, and is constructed of a flexible and pliable screen material formed of a series of interwoven strands that define drainage passages that extend between an inner surface and an outer surface of the flexible screen means;

support means for supporting the flexible screen means in a suspended manner;

fluid supply means for directing fluid onto the inner surface of the flexible screen means, wherein the fluid impinges on the inner surface of the flexible screen means at one or more impingement locations, wherein the flexibility of the screen means is operable to deflect the flexible screen means outwardly at the one or more impingement locations;

means interconnected with the support means for imparting movement to the screen means through the support means, wherein movement of the screen means varies the one or more impingement locations while the fluid is directed onto the inside surface of the screen means by the fluid supply means;

wherein the outward deflection of the screen means at the one or more impingement locations functions to vary the configuration of the drainage passages to dislodge any particulate matter located within the drainage passages, and wherein pressure applied by the fluid supply means at the one or more impingement locations functions to force the particulate matter located within the drainage passages through the drainage passages so as to prevent the build up of fine particles contained in the fluid within the openings of the screen means, and wherein the screen means functions to retain usable fibers on the inside surface of the screen means; and means for directing usable fibers on the surface of the screen means toward the discharge area of the screen means, to enable the usable fibers to be discharged from the screen means for recirculation into a papermaking process.

44. The fiber recovery system of claim 15, wherein the support means comprises frame means interconnected with an upper end defined by the screen means, and wherein the screen means defines a lower area located below the frame means that is unsupported.

45. The fiber recovery system of claim 44, wherein the screen means defines a conical configuration having an upper end connected to the frame means and a lower end defining the discharge area.

46. The fiber recovery system of claim 45, wherein the means for imparting movement to the screen means comprises means for rotating the frame means about a generally upright axis of rotation coincident with a longitudinal axis defined by the screen means.

47. The fiber recovery system of claim 46, wherein the fluid supply means comprises conduit means located within an interior defined by the screen means, wherein the conduit means includes a series of openings through which the fluid is applied to the inside surface of the screen means.

48. The fiber recovery system of claim 47, wherein the openings in the conduit means are configured and arranged to apply a force to the inside surface of the screen means tending to impart rotation to the screen means about the axis of rotation of the frame means.

49. The fiber recovery system of claim 44, wherein the frame means and the screen means are configured such that the screen means is suspended from the frame means and defines an upwardly open trough having an open end defining the discharge area of the screen means.

50. The fiber recovery system of claim 49, wherein the means for imparting movement to the screen means comprises means for varying the location at which the fluid is directed onto the screen means.

51. The fiber recovery system of claim 50, wherein the fluid supply means includes conduit means having an end through which the fluid is discharged, and further comprising discharge means interconnected with an end of the conduit means for varying the flow of the fluid and the location at which the fluid strikes the screen means.

52. The fiber recovery system of claim 49, wherein the means for imparting movement to the screen means comprises means for moving the frame means so as to impart movement to the screen means as the fluid is directed onto the surface of the screen means.

53. The fiber recovery system of claim 52, wherein the means for imparting movement to the screen means is operable to move the screen means in a direction transverse to a longitudinal axis defined by the trough, wherein transverse movement of the screen means is operable to roll the material in the trough.

54. The fiber recovery system of claim 53, wherein the frame means and the screen means are configured such that the trough defines a downwardly angled lower surface leading toward the discharge area, to assist in directing the material toward the discharge area upon movement of the screen means.

55. The fiber recovery system of claim 53, wherein the screen means is movable in an axial direction along a longitudinal axis defined by the trough.

56. The fiber recovery system of claim 55, wherein the frame means and the screen means are configured such that the trough defines a downwardly angled lower surface leading toward the discharge area, to assist in directing the usable fibers toward the open end upon movement of the screen means.

* * * * *

UNITED STATES PATENT AND TRADEMARK OFFICE

CERTIFICATE OF CORRECTION

PATENT NO. : 7,055,697 B2
APPLICATION NO. : 10/617286
DATED : June 6, 2006
INVENTOR(S) : Joseph P. McDonald It is certified that error appears in the above-identified patent and that said Letters Patent is hereby corrected as shown below:

IN THE CLAIMS

CLAIM 44, column 18, line 27, delete "15" and substitute therefore -- 43 --.

Signed and Sealed this

Nineteenth Day of September, 2006

JON W. DUDAS
*Director of the United States Patent and Trademark Office*